US005312223A

United States Patent [19]

Kleinhen

[11] Patent Number: 5,312,223

[45] Date of Patent: May 17, 1994

[54] APPARATUS FOR STACKING SIGNATURES

[75] Inventor: Stephen R. Kleinhen, Eaton, Ohio

[73] Assignee: AM International, Inc., Chicago, Ill.

[21] Appl. No.: 34,360

[22] Filed: Mar. 19, 1993

[51] Int. Cl.[5] ..... B65B 35/50

[52] U.S. Cl. ..... 414/788.3; 414/789.1; 414/790.4

[58] Field of Search ..... 414/790.4, 790.8, 790.9, 414/789.1, 788.3, 791.2, 794.4

[56] References Cited

U.S. PATENT DOCUMENTS

| | | | |
|---|---|---|---|
| 3,532,230 | 10/1970 | Gutberlet, et al. . | |
| 3,599,807 | 8/1971 | Hedrick et al. . | |
| 4,068,567 | 1/1978 | Allison et al. | 414/788.3 |
| 4,183,704 | 1/1980 | Steinhart . | |
| 4,457,656 | 7/1984 | Kosina et al. | 414/790.4 X |
| 4,657,465 | 4/1987 | Aoki | 414/788.3 |
| 4,678,387 | 7/1987 | Sjogren et al. . | |

FOREIGN PATENT DOCUMENTS

| | | | |
|---|---|---|---|
| 3736868 | 5/1989 | Fed. Rep. of Germany | 414/790.4 |

*Primary Examiner*—Cheryl L. Gastineau
*Attorney, Agent, or Firm*—Tarolli, Sundheim & Covell

[57] ABSTRACT

A stacker assembly receives signatures and supports the signatures as an intermediate stack is formed. A jogger assembly engages an intermediate stack supported by the stacker assembly to accurately align edge portions of the signatures. The stacks of signatures are deposited onto a turntable to form a main stack. The turntable rotates the main stack to offset relatively thick folded edge portions of signatures. The stacker assembly includes a plurality of slats which are moved along a first continuous circuitous path by a first drive assembly. The stacker assembly also includes a plurality of slats which are moved along a second continuous circuitous path by a second drive assembly. The drive assemblies move the slats along the continuous circuitous paths with the longitudinal axes of the slats horizontal and parallel. The jogger assembly has jogger plates which extend into central portions of the continuous circuitous paths along which the slats are moved by the drive assemblies.

59 Claims, 9 Drawing Sheets

APPARATUS FOR STACKING SIGNATURES

BACKGROUND OF THE INVENTION

The invention relates to a new and improved apparatus for use in stacking signatures and, more specifically, to an apparatus which receives signatures, forms intermediate stacks of signatures, and deposits the intermediate stacks of signatures on a main stack of signatures.

An apparatus which receives signatures, forms intermediate stacks of signatures and deposits the intermediate stacks of signatures on a main stack of signatures is disclosed in U.S. Pat. No. 4,068,567, issued Jan. 17, 1978 and entitled "Combined Ejector-Gate Means for Rotatable Table of an Article Counter-Stacker". The apparatus disclosed in this patent includes a stacker section which receives newspapers. The newspapers are stacked on cooperating pairs of upwardly angled blades carried on endless chains. A stack supporting table is disposed beneath the stacker section and receives stacks of signatures from the stacker section. The table is rotatable to offset relatively thick folded edge portions of the signatures received from the stacker section. Apparatus for use in forming stacks of signatures is also disclosed in U.S. Pat. Nos. 3,532,230; 3,599,807; 4,183,704; and 4,678,387.

SUMMARY OF THE INVENTION

The present invention relates to a new and improved apparatus for use in stacking signatures. The apparatus includes first and second pluralities of longitudinally extending signature support elements, referred to herein as slats. One of the slats of the first plurality of slats cooperates with one of the slats of the second plurality of slats to support an intermediate stack of signatures. The slats have longitudinal axes which are maintained parallel to each other during movement of the slats along a pair of spaced apart circuitous paths by a pair of drive assemblies.

A jogger assembly is operable to jog a stack of signatures supported by the slats in the stacker assembly. The jogger assembly has jogger plates which are enclosed by the circuitous paths along which the slats move. The jogger plates and slats are disposed above a receiving platform, which may be a turntable.

The turntable includes a platform having a horizontal upper surface which is parallel to longitudinal axes of the slats and perpendicular to side surfaces of the jogger plates. Each time an intermediate stack of signatures is transferred from the stacker assembly to the turntable, the platform on which the main stack of signatures is disposed is rotated through one-half of a revolution. Rotation of the platform offsets the relatively thick folded edge portions of signatures on the turntable relative to the folded edge portions of the next succeeding intermediate stack of signatures. The platform is rotated by a drive assembly which includes a cam follower which is moved vertically relative to a helical cam to rotate the platform.

BRIEF DESCRIPTION OF THE DRAWINGS

The foregoing and other features of the invention will become more apparent upon a consideration of the following description taken in connection with the accompanying drawings wherein.

DESCRIPTION OF ONE SPECIFIC PREFERRED EMBODIMENT OF THE INVENTION

General Description

Figure 1:
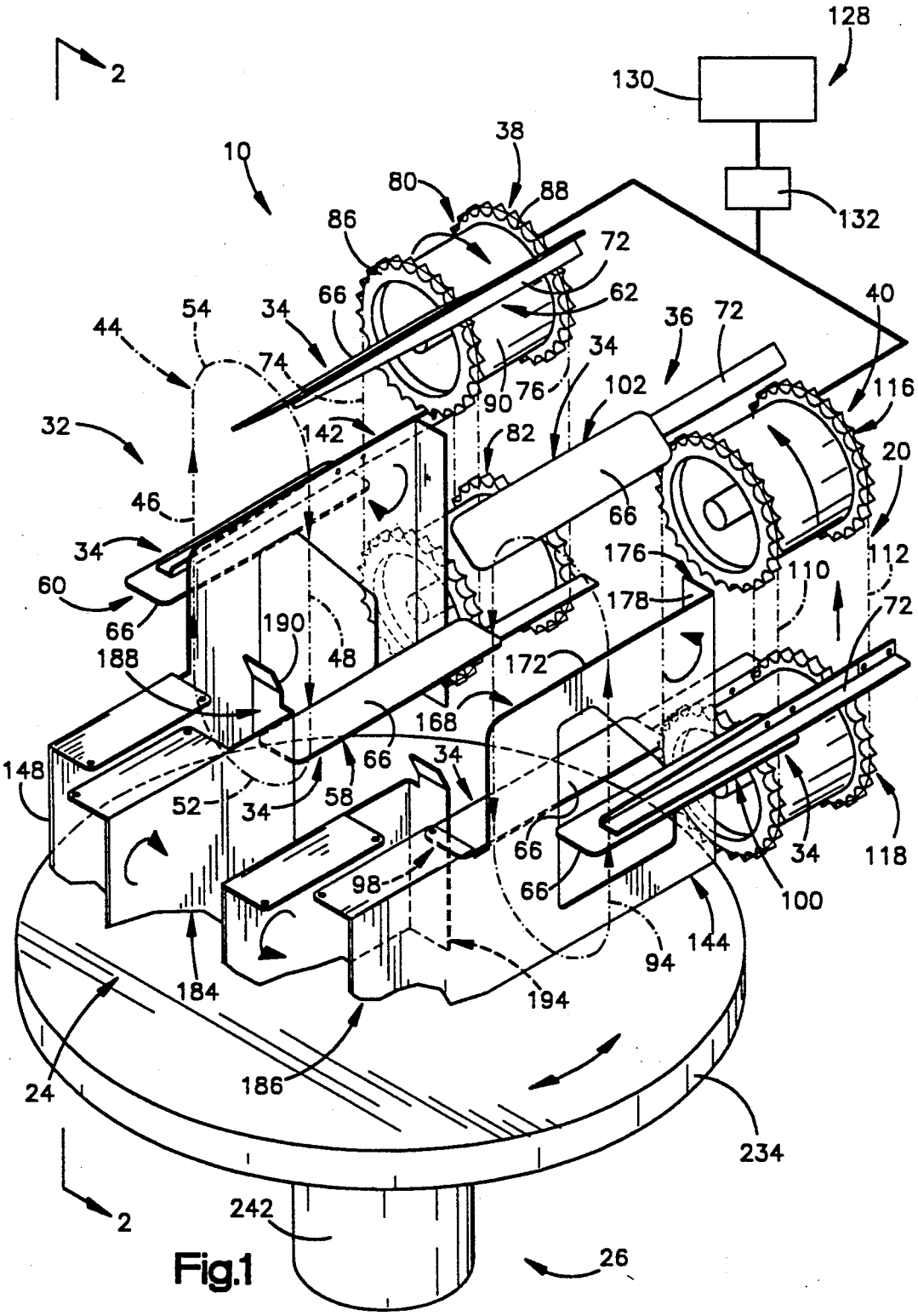
FIG. 1 is a highly schematicized illustration of an apparatus constructed in accordance with the present invention and schematically depicting the relationship between a stacker assembly, a jogger assembly and a turntable.

An apparatus 10 for use in stacking signatures is illustrated schematically in FIG. 1. The apparatus 10 receives signatures 12 (FIG. 2) from an infeed conveyor 14 in a stream 16. The signatures 12 are conducted in the stream 16 with folded edge portions of the signatures leading and open edge portions of the signatures trailing. The signatures 12 are formed into an intermediate stack 18 in a stacker assembly 20.

Figure 2:
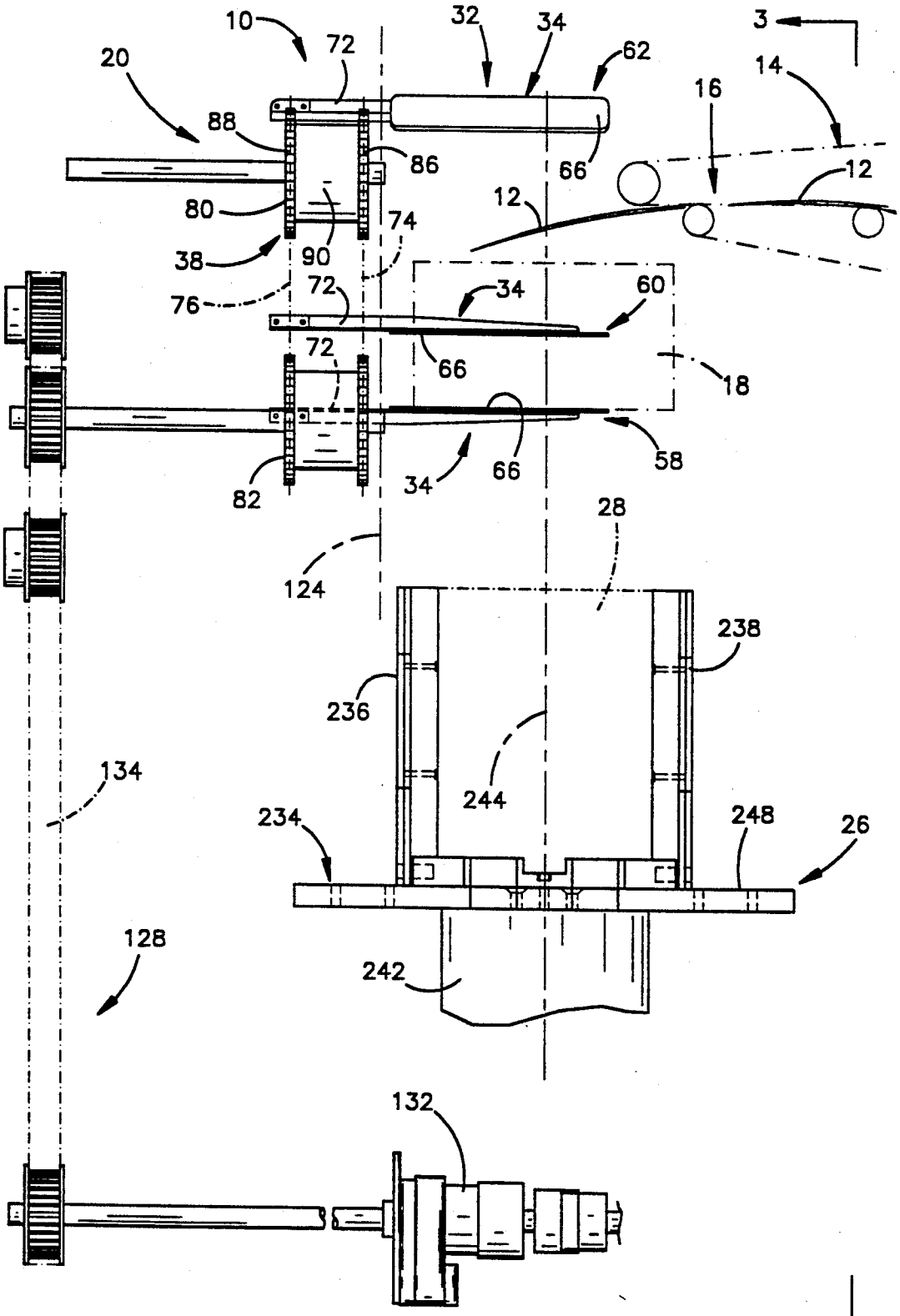
FIG. 2 is a side elevational view, taken generally along the line 2—2 of FIG. 1, illustrating the manner in which a stream of signatures is fed into the stacker assembly and the relationship of the stacker assembly to the turntable.
Figure 3:
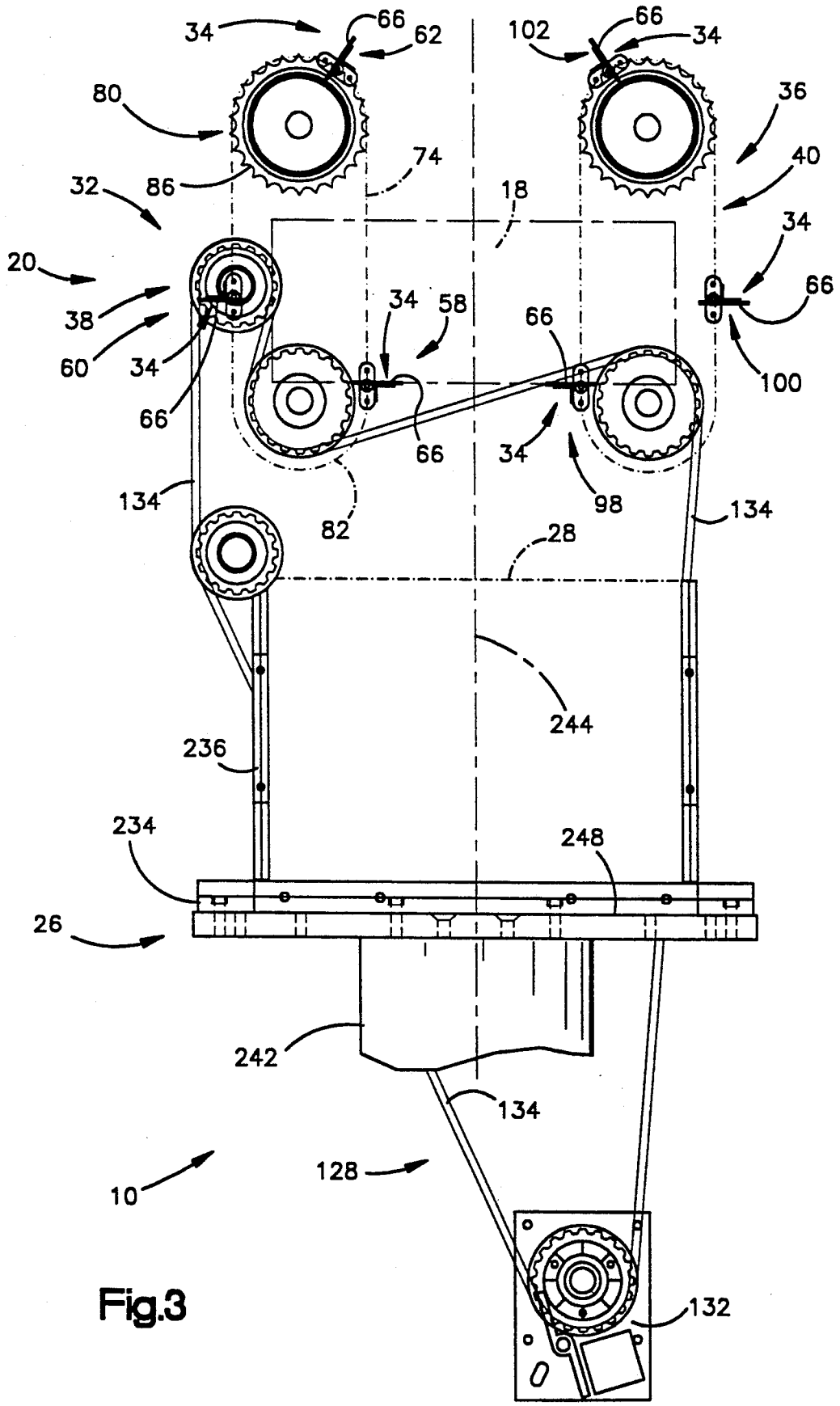
FIG. 3 is an elevational view, taken generally along the line 3—3 of FIG. 2, further illustrating the relationship between the stacker assembly and turntable.

While the intermediate stack 18 is supported in the stacker assembly 20, a jogger assembly 24 (FIGS. 1 and 5A) is operable to jog the intermediate stack 18 (FIG. 2) of signatures to align opposite edge portions of the signatures in the intermediate stack of signatures. Thus, as the intermediate stack 18 of signatures is formed in the stacker assembly 20, the jogger assembly 24 (FIG. 1) is continuously operated to align the edge portions of the signatures. After the intermediate stack 18 of signatures has been formed in the stacker assembly 20, the intermediate stack of signatures is deposited onto a receiving platform, which, in the illustrated embodiment of the invention, is a turntable 26 (FIGS. 2 and 3). When the receiving platform is the turntable 26, the intermediate stack 18 of signatures is received on a main stack 28 of signatures on the turntable 26.

Each time an intermediate stack 18 of signatures is deposited on the turntable 26 by the stacker assembly 20, the turntable 26 rotates the main stack 28 through one-half of a revolution. By rotating the main stack 28 through one-half of a revolution each time an intermediate stack 18 of signatures is deposited on the main stack, the relatively thick folded edge portions of the signatures in the intermediate stacks are offset from each other. This results in the main stack 28 of signatures as being composed of layers of signatures having folded edge portions in one layer of signatures offset by 180° from the folded edge portions of the next succeeding layer of signatures. Therefore, the upper side of the main stack 28 of signatures is generally horizontal so that the main stack of signatures is relatively stable.

A suitable conveyor assembly (not shown) is provided to sequentially move main stacks 28 of signatures from the turntable 26. Thus, after a sufficient number of intermediate stacks 18 of signatures have been deposited on the turntable 26 by the stacker assembly 20 to form a main stack 28 of a desired size, the main stack is removed from the turntable 26 for further processing. A main stack 28 of signatures can be completely removed from the turntable 26 in substantially less time then is required to form an intermediate stack 18 of signatures. It is contemplated that it may be desired to eliminate the accumulation of intermediate stacks 18 on the turntable 26 and the formation of a relatively large main stack 28. If this is the case, the turntable 26 may be replaced by a stationary platform. The conveyor assembly would be operated to move each intermediate stack 18 off of the platform in turn before the next succeeding intermediate stack is received on the platform.

Stacker Assembly

The infeed conveyor 14 (FIG. 2) feeds signatures 12 to the stacker assembly 20 in a stream 16 with folded edge portions of the signatures leading. The signatures 12 are supported in the stacker assembly 20 until sufficient signatures have accumulated to form an intermediate stack 18 of a desired size. A completed intermediate stack 18 of signatures is then transferred from the stacker assembly 20 to the turntable 26 and a next succeeding intermediate stack of signatures started without interrupting the stream 16 of signatures.

The stacker assembly 20 includes a first plurality 32 (FIG. 1) of longitudinally extending signature support elements 34, hereinafter referred to as slats. The stacker assembly 20 also includes a second plurality 36 of slats 34. Each of the slats 34 of the first plurality 32 of slats is moved along a circuitous path by a first drive assembly 38. Each of the slats 34 of the second plurality 36 of slats is moved along a circuitous path by a second drive assembly 40.

The first drive assembly 38 moves each of the slats 34 in the first plurality 32 of slats along a first circuitous path, which has been indicated at 44 in FIG. 1. The first circuitous path 44 has a vertical left or outer run 46 along which the slats 34 of the first plurality 32 of slats move vertically upwardly. In addition, the circuitous path 44 has a vertical right or inner run 48 along which the slats 34 of the first plurality 32 of slots move vertically downwardly. A lower semi-circular connector portion 52 interconnects the lower ends of the outer and inner runs 46 and 48 of the circuitous path 44. A semi-circular upper section 54 interconnects the upper ends of the outer and inner runs 46 and 48.

The first drive assembly 38 is operable to intermittently move the slats 34 in a clockwise direction (as viewed in FIG. 1) along the circuitous path 44 between a loading position, indicated at 58 in FIGS. 1 and 3, an intermediate position indicated at 60 in FIGS. 1 and 3, and a standby position indicated at 62 in FIGS. 1 and 3. The first drive assembly 38 is operable to quickly index the slats 34 between loading position 58, intermediate position 60 and standby position 62. The longitudinal central axes of the slats 34 are maintained horizontal and parallel to each other at all times during movement of the slats along the first circuitous path 44 (FIG. 1).

When a slat 34 is in the loading position 58 (FIGS. 1 and 3), a flat front side surface 66 on the slat 34 is horizontal and faces upwardly. When the slat 34 has been moved along the first circuitous path 44 to the intermediate position 60, the flat front side surface 66 of the slat is also horizontal. However, at this time, the front side surface 66 of the slat 34 faces downwardly (see FIGS. 1 and 3). When the slat 34 has been moved to the standby position 62, the longitudinal central axis of the slat is still horizontal. However, at this time, the flat front side surface 66 on the slat 34 is sloped at an angle of approximately 45° to a horizontal plane (FIG. 3).

Figure 5A:
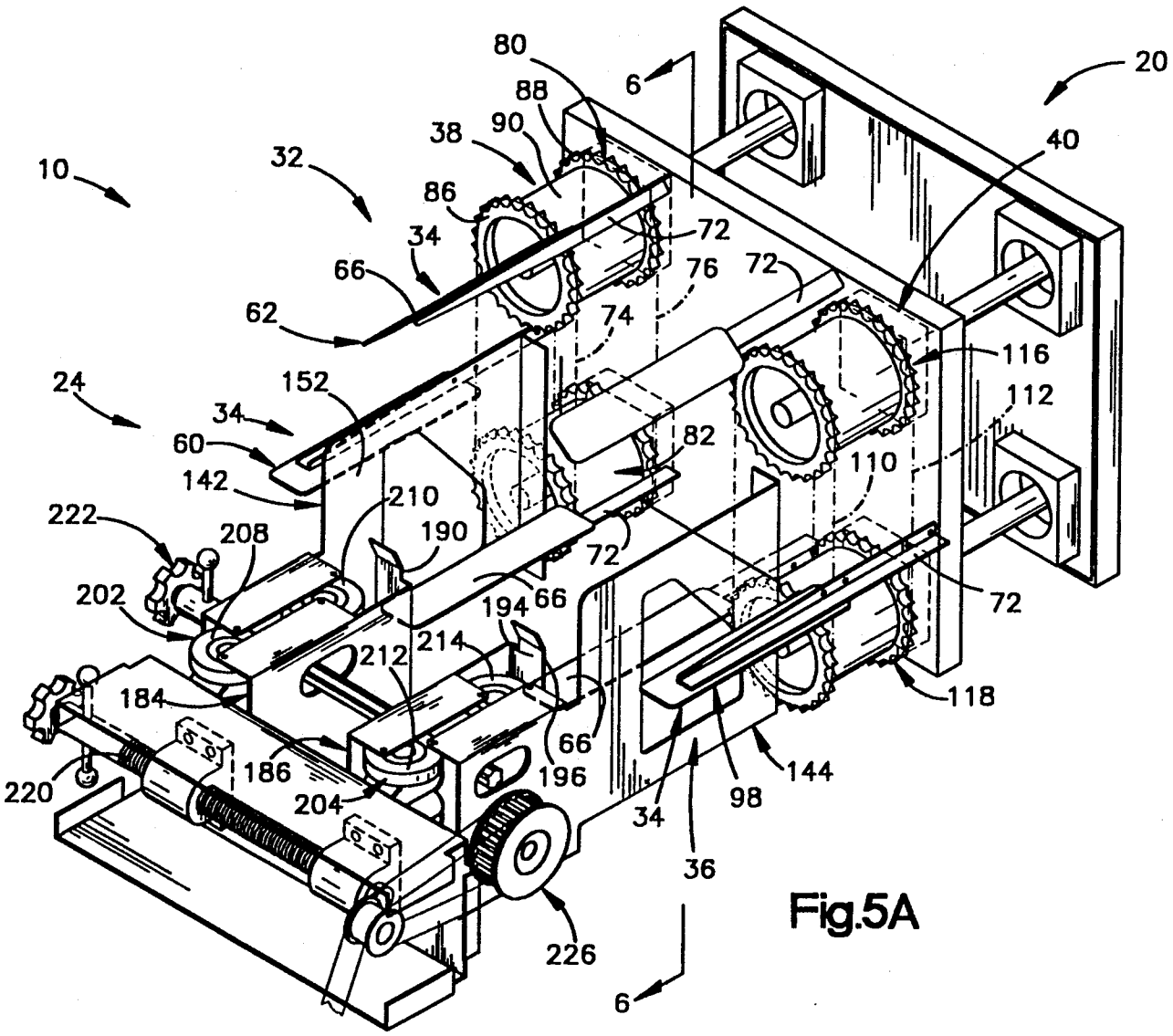
FIG. 5A is a fragmentary pictorial illustration depicting the relationship between the stacker assembly and a jogger assembly.

Inner end portions 72 (FIGS. 1 and 2) of the slats 34 of the first plurality 32 of slats are connected to the first drive assembly 38. In the illustrated embodiment of the invention, the first drive assembly 38 includes a pair of flexible drive elements or chains 74 and 76 (FIGS. 2 and 5A). The chains 74 and 76 move along a circuitous path which is of the same size and orientation as the circuitous path 44 and which is coextensive with a portion of the circuitous path 44. It should be understood that although chains 74 and 76 have been used in the first drive assembly 38, it is contemplated that the chains 74 and 76 could be replaced by a single relatively wide belt if desired. Of course, a pair of belts could also be used if desired.

Figure 4:
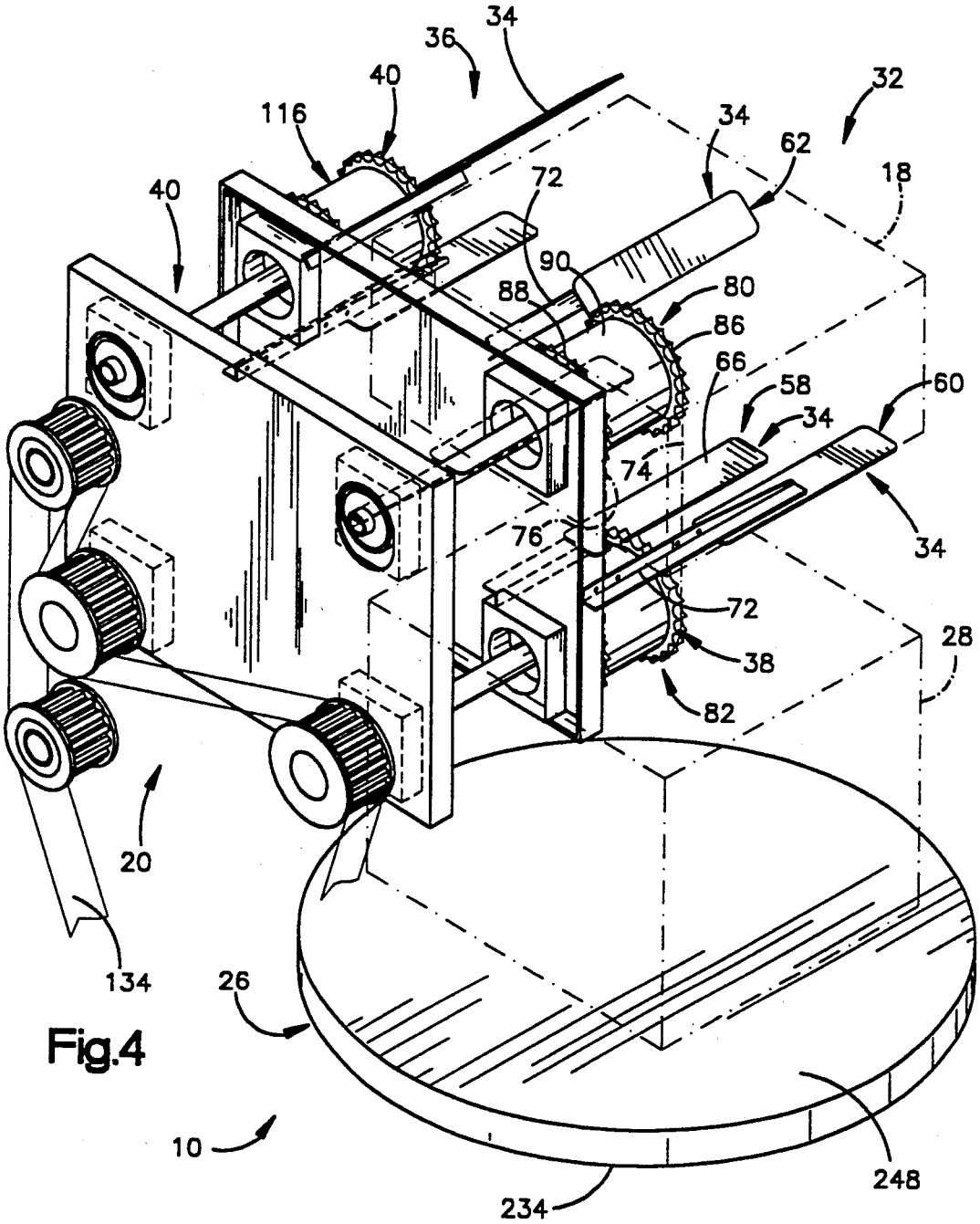
FIG. 4 is a fragmentary schematicized illustration depicting the manner in which an intermediate stack of signatures is supported in the stacker assembly and a main stack of signatures is supported by the turntable.

The chains 74 and 76 extend around upper and lower sprocket wheel assemblies 80 and 82 (FIGS. 4 and 5A). The upper sprocket wheel assembly 80 includes a pair of sprockets 86 and 88 (FIG. 4) which are interconnected by a cylindrical hub 90. The lower sprocket wheel assembly 82 has the same construction as the upper sprocket wheel assembly 80. The sprocket wheel assemblies 80 and 82 are rotatable about horizonal axes which are disposed in a vertical plane.

The inner end portions 72 of the slats 34 are fixedly connected to the chains 74 and 76 (FIGS. 2). The chains 74 and 76 support the slats 34 in a cantilevered relationship. Thus, the slats 34 extend horizontally outwardly from the chains 74 and 76 to free end portions. The chains 74 and 76 move along the circuitous path 44 to move the inner end portions 72 of the slats 34 along the circuitous path.

The slats 34 in the second plurality 36 of slats are moved along a continuous circuitous path indicated schematically at 94 in FIG. 1. The continuous circuitous path 94 has the same configuration and orientation as the continuous circuitous path 44. The slats 34 are moved along the continuous circuitous path 94 in a counterclockwise direction between a loading position 98, an intermediate position 100 and a standby position 102 (FIGS. 1 and 3). These positions correspond to and are horizontally aligned with the loading position 58, intermediate position 60 and standby position 62 for the first plurality 32 of slats 34.

During movement of the slats 34 of the second plurality 36 of slats along the continuous circuitous path 94 (FIG. 1), the longitudinal axes of the slats 34 are maintained horizontal and parallel to the longitudinal axes of the slats 34 in the first plurality 32 of slats. When a slat 34 in the second plurality 36 of slats is at the loading position 98, a flat front side surface 66 (FIGS. 1 and 3) of the slat is horizontal and faces upwardly. When a slat 34 has been moved from the loading position 98 to the intermediate position 100, the front surface 66 is still horizontal. However, at this time, the front surface 66 faces downwardly. When the slat 34 is moved to the standby position 102, the surface 66 slopes at an angle of approximately 45° to a horizontal plane.

A slat 34 which is at the loading position 58 has a horizontal front side surface 66 which is disposed in the same plane as the horizontal front side surface of a slat at the loading position 98 (FIG. 3). The slats 34 at the loading positions 58 and 98 are spaced apart by a horizontal distance which is less than the length of a folded edge portion of a signature 12. The signatures 12 are fed into the stacker assembly 20 at a location which is above the slats 34 at the loading positions 58 and 98 (FIGS. 2 and 3). Therefore, the signatures are supported on the upwardly facing coplanar front side surfaces 66 of the slats 34 at the loading positions 58 and 98 (FIG. 3).

When sufficient signatures 12 have been accumulated on the slats at the loading positions 58 and 98, the first and second drive assemblies 38 and 40 are operated to quickly index the slats 34 along the circuitous paths 44 and 94 (FIG. 1). As the slats 34 move downwardly from the loading positions 58 and 98, they are moved away from each other and rotated to deposit an intermediate stack 18 on the main stack 28 of signatures on the turntable 26. Thus, the vertical outer runs of the circuitous paths 44 and 94 (FIG. 1) are spaced apart by a horizontal distance which is greater than the length of the folded edge portions of the signatures 12 (FIGS. 1, 2 and 3).

The second drive assembly 40 has the same construction as the first drive assembly 38 and is connected with the slats 34 of the second plurality 36 of slats in the same manner as in which the first drive assembly 38 is connected with the slats of the first plurality 32 of slats. Thus, the second drive assembly 40 includes a pair of chains 110 and 112 (FIG. 5A) corresponding to the chains 74 and 76 in the first drive assembly 38. The chains 110 and 112 along a circuitous path which is of the same size and orientation as the circuitous path 94 and which is coextensive with a portion of the circuitous path 94.

The chains 110 and 112 in the second drive assembly 40 extend around upper and lower sprocket wheel assemblies 116 and 118. The sprocket wheel assemblies 116 and 118 are rotatable about horizontal axes. The horizontal axes about which the sprocket wheel assemblies 116 and 118 rotate are disposed in a vertical plane which is parallel to a vertical plane containing horizontal axes about which the upper and lower sprocket wheel assemblies 80 and 82 of the first drive assembly 38 are rotatable.

The end portions 72 of the slats 34 of the second plurality 36 of slats are connected with the chains 110 and 112 in the same manner as previously described for the slats of the first plurality 32 of slats. The slats 34 of the second plurality 36 of slats are supported in a cantilevered relationship from the chains 110 and 112 with their longitudinal central axes horizontal and parallel to each other. The longitudinal axes of the slats 34 in the second plurality 36 of slats are maintained in a parallel relationship with the horizontal longitudinal axes of the slats in the first plurality 32 of slats and with the horizontal axes about which the sprocket wheel assemblies 80, 82, 116 and 118 rotate during movement of the slats along the circuitous paths 44 and 94 (FIG. 1).

The slats 34 in the first plurality 32 of slats and drive chains 74 and 76 move in a clockwise direction (as viewed in FIG. 1) around the circuitous path 46. The slats 34 in the second plurality 36 of slats and drive chains 110 and 112 move in a counterclockwise direction (as viewed in FIG. 1) around the circuitous path 94. Movement of the slats 34 in the first plurality 32 of slats is coordinated with the movement of the slats in the second plurality 36 of slats. The slats 34 in the first and second pluralities 32 and 36 of slats simultaneously move downward toward the loading positions 58 and 98 with the front side surfaces 66 of the slats horizontal and disposed in the same plane. This enables a slat 34 in the first plurality 32 of slats and a slat 34 in the second plurality 36 of slats to cooperate with each other to lower signatures as the two slats move downwardly to their respective loading positions 58 and 98. In addition, once the two slats have reached their respective loading positions 58 and 98, the slats are stationary and cooperate with each other to support the signatures while an intermediate stack 18 of signatures 12 of a desired size is accumulated on the two slats.

Figure 7:
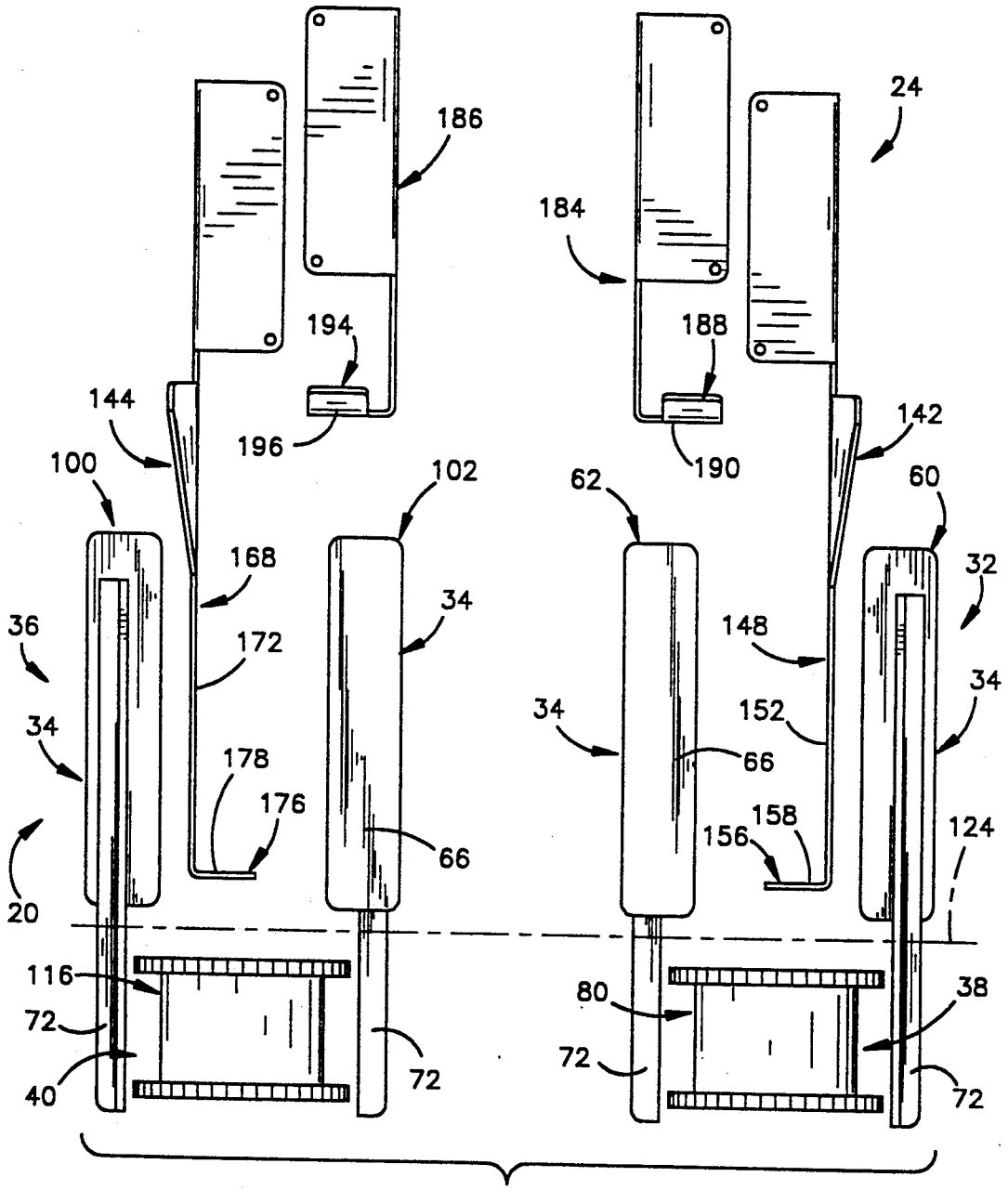
FIG. 7 is a schematic plan view, taken generally along the line 7—7 of FIG. 6, further illustrating the relationship between the slats in the stacker assembly and the jogger plates in the jogger assembly.

The drive assemblies 38 and 40 for the first and second pluralities 32 and 36 of slats 34 are disposed on one side of a vertical plane 124 (FIGS. 2 and 7). The drive chains 74 and 110 (FIG. 5A) are disposed in a plane which is parallel to the plane 124 (FIG. 2). The drive chains 76 and 112 are also disposed in a plane which is parallel to the plane 124. The circuitous paths 44 and 94 (FIG. 1) are parallel to the plane 124 (FIGS. 2 and 7).

The slats 34 of the first and second pluralities 32 and 36 of slats have longitudinal axes which are maintained perpendicular to the vertical plane 124 throughout movement of the slats along the circuitous paths 44 and 94 (FIG. 1). Therefore, a front side surface 66 on each of the slates 34 is perpendicular to the plane 124 (FIGS. 2 and 7) throughout movement of the slats along the circuitous paths 44 and 94. The front side surfaces 66 on the slats 34 are disposed on a side of the vertical plane 124 opposite from the drive assemblies 38 and 40 (FIG. 7) throughout movement of the slats 34 along the circuitous paths 44 and 94. The mounting sections 72 of the slats 34 extend through the vertical plane 124 and are connected with first and second drive assemblies 38 and 40.

The slats 34 support an intermediate stack 18 of signatures (FIG. 2) on a side of the vertical plane 124 opposite from the side on which the drive assemblies 38 and 40 are located. Thus, an intermediate stack 18 of signatures supported by the slats 34 is entirely disposed on the right (as viewed in FIG. 2) side of the vertical plane 124. The first and second drive assemblies 38 and 40 (FIGS. 2 and 7) are entirely disposed on the left (as viewed in FIG. 2) side of the vertical plane 124.

The vertical plane 124 extends parallel to the circuitous paths 44 and 94 along which the slats 34 are moved. The sprocket assemblies 80, 82, 116 and 118 (FIGS. 5 and 6) of the drive assemblies 38 and 40 are rotatable about horizontal axes which extend parallel to each other and perpendicular to the vertical plane 124 (FIGS. 2 and 7). The horizontal axes about which the sprocket wheel assemblies 80, 82, 116 and 118 are rotatable are disposed in two parallel vertical planes which extend perpendicular to the vertical plane 124. The horizontal longitudinal axes of the slats 34 are maintained parallel to the planes containing the axes of rotation of the sprocket wheel assemblies 80, 82, 116 and 118. An intermediate stack 18 of signatures extends through the parallel vertical planes containing the axes of rotation of the sprocket wheel assemblies 80, 82, 116 and 118.

A main drive system 128 (FIGS. 1, 2 and 3) is connected with the drive assemblies 38 and 40. The main drive system 128 includes a main drive motor 130 (FIG. 1) which is connected with the drive assemblies 38 and 40 through a single revolution clutch 132. The single revolution clutch 132 (FIGS. 2 and 3) drives a main drive belt 134. The drive belt 134 is intermittently driven to operate the drive assemblies 38 and 40.

Operation of the drive assemblies 38 and 40 simultaneously indexes the slats 34 in the first plurality 32 of slats and the slats in the second plurality of slats 36 between the loading positions 58 and 98, intermediate positions 60 and 100 and standby positions 62 and 102 (FIG. 3). The slats 34 are indexed by the drive assemblies 38 and 40 along the circuitous paths 44 and 94 (FIG. 1). The slats 34 are then stopped while an intermediate stack 18 (FIG. 3) of signatures accumulates on a pair of slats 34 disposed at the loading positions 58 and 98.

After the slats have been stationary for a sufficient length of time to enable an intermediate stack 18 of a desired height to accumulate on the slats at the loading positions 58 and 98, the single revolution clutch 132 effects operation of the drive assemblies 38 and 40 to again index the slats 34. This results in the intermediate stack of signatures being deposited on the turntable 26 as a pair of slats 34 move away from the loading positions 58 and 98 and a next succeeding pair of slats move quickly from the standby positions 62 and 102 to the loading positions. It should be noted that the slats 34 can be readily moved into the stream 16 (FIG. 2) of signatures 12 from the infeed conveyor 14 with minimum disturbance. This is because the slats 34 are of a relatively small width as measured on the front side surfaces 66 and perpendicular to the longitudinal central axes of the slats.

Although many different types of single revolution clutches 132 could be used, in one specific embodiment of the invention, the single revolution clutch 132 was obtained from Warner Electric and was a Super CB-6 wrap spring clutch. Warner Electric has a place of business at Beloit, Ill. It should also be understood that an intermittent drive mechanism other than a single revolution clutch could be used if desired.

Jogger Assembly

Figure 5B:
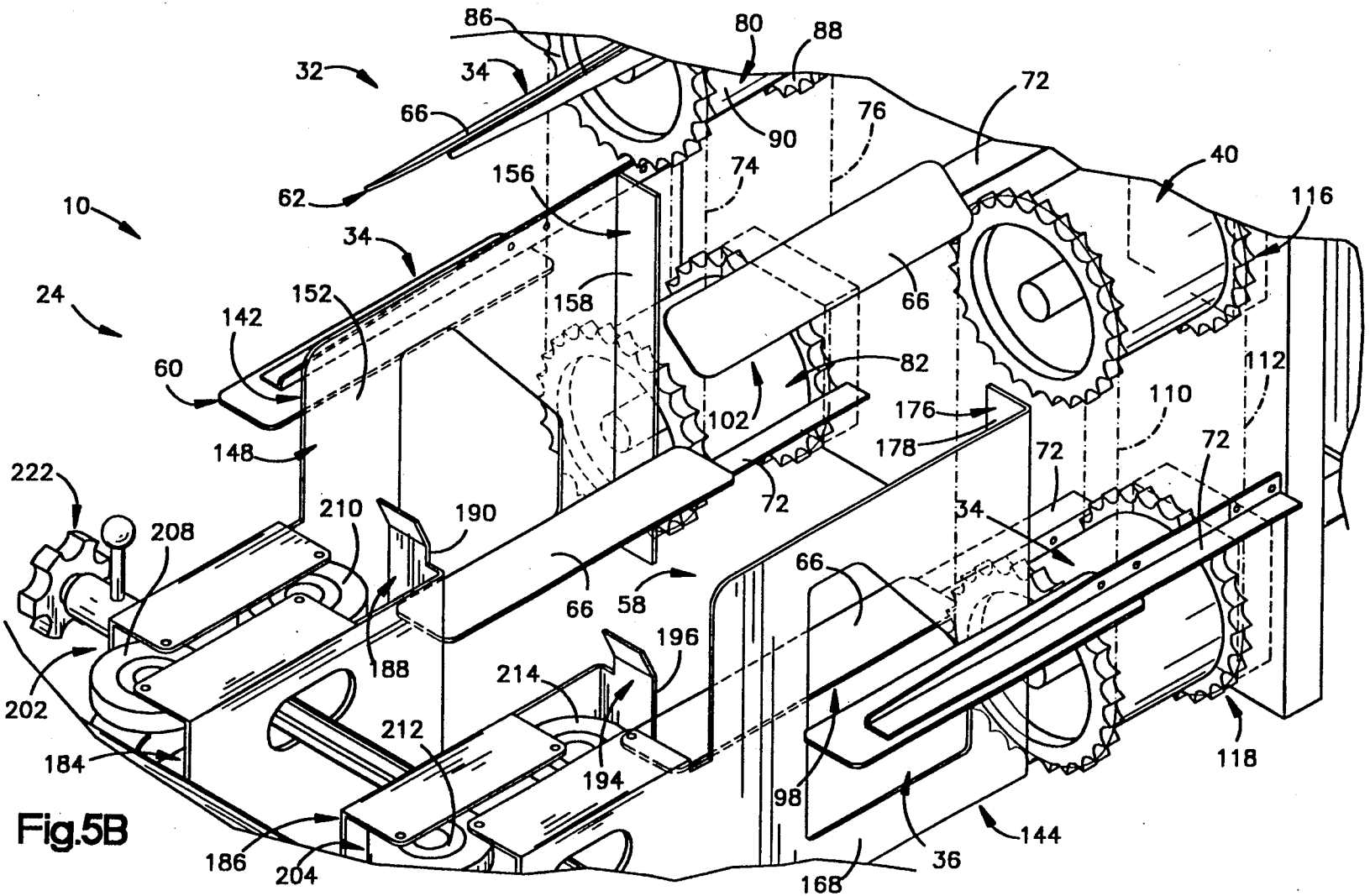
FIG. 5B is an enlarged portion of FIG. 5A.
Figure 6:
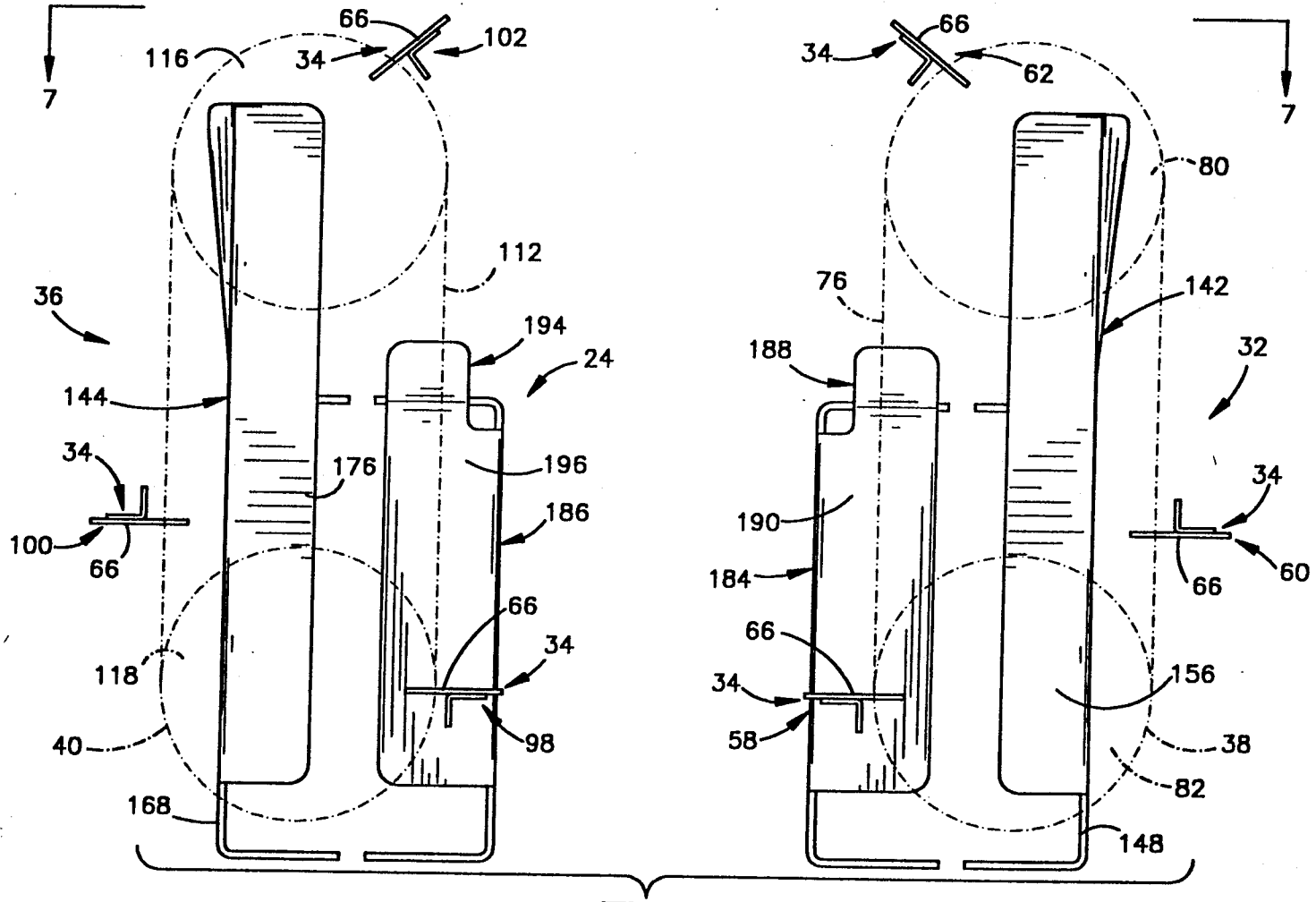
FIG. 6 is a schematic elevational view, taken generally along the line 6—6 of FIG. 5A, illustrating the relationship between slats in the stacker assembly and jogger plates in the jogger assembly.

The jogger assembly 24 (FIGS. 5A, 5B, 6 and 7) cooperates with the stacker assembly 20 to jog an intermediate stack 18 of signatures while the intermediate stack of signatures is supported by slats 34. The jogger assembly 24 includes a pair of side plates 142 and 144 (FIGS. 5A and 5B). The side plate 142 extends into the central portion of the circuitous path 44 (FIG. 1). The side plate 144 extends into the central portion of the circuitous path 94. The slats 34 in the first plurality 32 of slats are moved around the side plate 142 along the continuous circuitous path 44 by the first drive assembly 38. Similarly, the slats 34 in the second plurality 36 of slats are moved around the side plate 144 along the continuous circuitous path 94 by the second drive assembly 40. The loading positions 58 and 98 (FIG. 3) and the vertical inner runs of the circuitous paths 44 and 94 (FIG. 1) are disposed between the side plates 142 and 144.

The side plate 142 of the jogger assembly 24 includes a vertical side section 148 (FIG. 5B). The side section 148 extends parallel to the longitudinal axes of the slats 34 of the first plurality 32 of slats and perpendicular to the vertical plane 124 (FIG. 7). Although the side section 148 of the jogger side plate 142 extends perpendicular to the vertical plane 124, the jogger side plate 142 does not extend through the vertical plane 124.

The side section 148 of the jogger side plate 142 (FIG. 5B) has a flat vertical side surface 152 which extends perpendicular to the vertical plane 124 (FIG. 7) and parallel to the longitudinal axes of the slats 34 of the first plurality 32 of slats. The side surface 152 of the jogger side plate 142 is engageable with one end of an intermediate stack 18 of signatures supported in the stacker assembly 20. The side surface 152 is reciprocated toward and away from the end of the intermediate stack 18 of signatures to jog the end portions of the signatures into alignment with each other.

A vertical end section 156 (FIG. 5B) of the jogger side plate 142 extends perpendicular to the side section 148 and parallel to the vertical plane 124 (FIG. 7). The end section 156 of the side plate 142 has a flat vertical side surface 158 which extends parallel to the vertical plane 124 and is engageable with a side of the intermediate stack 18 of signatures. The side surface 158 on the end section 156 engages the side of the intermediate stack 18 of signatures. The side surface 158 is reciprocated toward and away from the side of the intermediate stack 18 of signatures to jog the folded edge portions of the signatures into alignment with each other.

The side plate 144 (FIG. 5B) of the jogger assembly 24 has a construction which is similar to the construction of the side plate 142. Thus, the side plate 144 includes a side section 168 having a flat vertical side surface 172 (FIG. 7) which extends perpendicular to the vertical plane 124. The side surface 172 on the side section 168 extends parallel to the side surface 152 on the side section 148 of the jogger side plate 142. The side surface 172 on the side section 168 of the jogger side plate 144 is parallel to the longitudinal axes of the slats 34 in the second group 36 of slots throughout movement of the slats along the circuitous path 94 (FIG. 1). The vertical portions of the circuitous paths 44 and 94 along which the slats 34 move downwardly are disposed between the jogger side plates 142 and 144.

An end section 176 on the jogger side plate 144 (FIG. 5B) extends perpendicular to the side section 168 and is parallel to the vertical plane 124. The end section 176 has a vertical side surface 178 disposed in the same plane as the vertical side surface 158 on the end section 156 of the side plate 142. The end sections 156 and 176 on the jogger side plates 142 and 144 are disposed on a side of the vertical plane 124 (FIG. 7) opposite from the drive assemblies 38 and 40. The side surface 178 is reciprocated toward and away from the side of the intermediate stack 18 of signatures to jog the folded edge portions the signatures into alignment with each other.

The flat side surface 172 (FIG. 7) on the side section 168 is engageable with an end of an intermediate stack 18 opposite from the end which is engaged by the side surface 152 on the side section 148 of the side plate 142. The side surface 178 disposed on the end section 176 of the side plate 144 is engageable with the side surface of the intermediate stack 18 of signatures which is the same as the side surface of the intermediate stack which is engaged by the side surface 158 on the end section 156. The folded edge portions of the signatures 12 are engaged by the end sections 156 and 176.

In addition to the side plates 142 and 144, the jogger assembly 24 has a pair of back plates 184 and 186 (FIGS. 5A and 7). The back plates 184 and 186 are disposed outwardly from free end portions of the cantilevered slats 34 (FIGS. 6 and 7) disposed at the loading positions 58 and 98.

The back plate 184 has an end section 188 with a flat vertical side surface 190 (FIG. 7) which extends parallel to the flat side surface 158 on the end section 156 of the side plate 142 and parallel to the vertical plane 124. The side surface 190 on the end section 188 of the back jogger plate 184 is engageable with a side of an intermediate stack 18 of signatures supported by the stacker assembly 20. The side surface 190 on the jogger back plate 124 is reciprocated toward and away from the side of the intermediate stack 18 opposite from the folded edge portions of the signatures 12 to jog the open edge portions of the signatures into alignment with each other.

The jogger back plate 186 has an end section 194 with a vertical side surface 196. The side surface 196 on the end section 194 of the jogger plate 186 is disposed in the same vertical plane as the side surface 190 on the end section 188 of the jogger back plate 184. The side surface 196 is engageable with the same side of an intermediate stack 18 of signatures as is the side surface 190. The side surface 196 on the jogger back plate 186 is reciprocated toward and away from the side of the intermediate stack 18 opposite from the folded edge portions of the signatures 12 to jog the open edge portions of the signatures into alignment.

The side surfaces 190 and 196 on the jogger back plates 184 and 186 are engageable with a side of an intermediate stack 18 opposite from a side engaged by the side surfaces 158 and 178 on the jogger side plates 148 and 168. The side surface 196 on the jogger back plate 186 extends parallel to the side surface 178 on the end section 176 of the jogger side plate 144 and to the vertical plane 124. The side surfaces 190 and 196 on the jogger back plates 184 and 186 are disposed in a vertical plane which is perpendicular to the longitudinal axes of the slats 34 in the loader assembly 20 and parallel to the vertical plane 124.

A pair of eccentric drive assemblies 202 and 204 (FIGS. 5A and 5B) are provided to oscillate the jogger plates 142, 144, 184 and 186. The eccentric drive assemblies 202 and 204 include a plurality of drive disks 208, 210, 212 and 214 (FIG. 5B). The drive disks 208, 210, 212 and 214 are connected to the jogger plates 142, 144, 184 and 186.

The drive disks 208, 210, 212 and 214 are oscillated about vertical axes which are offset from their central axes. Oscillation of the drive disks 208, 210, 212 and 214 effects movement of the side sections 148 and 168 (FIG. 5B of the jogger side plates 142 and 144 toward and away from opposite ends of an intermediate stack of signatures supported by the stacker assembly 20. In addition, oscillation of the drive disks 208, 210, 212, and 214 effects movement of the end sections 156 and 176 of the jogger side plates 142 and 144 toward and away from the side of the intermediate stack 18 which extends between the opposite ends of the stack.

The jogger side plates 142 and 144 are reciprocated toward and away from the vertical plane 124 (FIG. 7). The jogger side plates 142 and 144 are also reciprocated toward and away from each other. This enables the jogger side plates 142 and 144 to align signature edges at opposite ends of an intermediate stack and along one side of an intermediate stack closest to the vertical plane 124. The jogger back plates 184 and 186 cooperate with the side plates 142 and 144 to align edges of signatures on opposite sides of an intermediate stack of signatures supported in the stacker assembly 20.

A stack length adjustment screw 220 (FIG. 5A) having opposite hand threads is rotatable to adjust the distance between the jogger side plates 142 and 144 to accommodate stacks of different lengths. A stack width adjustment 222 is operable to actuate the eccentric drive assemblies 202 and 204 to adjust the eccentricity of the disks 208, 210, 212 and 214. Adjusting the eccentricity of the disks 208, 210, 212, and 214 adjusts the distance between the end sections 188 and 194 on the back plates 184 and 186 and the end sections 156 and 176 on the side plates 142 and 144. This enables stacks of different widths to be accommodated between the end sections 188 and 194 on the jogger back plates 184 and 186 and the end sections 156 and 176 on the jogger side plates 142 and 144.

A drive assembly 226 (FIG. 5A) for the eccentric drive assemblies 202 and 204 is driven by a suitable motor (not shown) to effect oscillation of the disks 208, 210, 212 and 214 to oscillate the jogger plates 142, 144, 184 and 186 to jog an intermediate stack 18 of signatures while the signatures are supported by the stacker assembly 20. The drive assembly 226 and the eccentric drives 202 and 204 are located outwardly from the free ends of the cantilevered slats 34. Thus, the entire jogger assembly 24 is disposed on a side of the vertical plane 124 (FIG. 7) which is opposite from the first and second drive assemblies 38 and 40.

Turntable

The turntable 26 is disposed beneath the slats 34 of the stacker assembly 20 and the jogger plates 142, 144, 184 and 186 of the jogger assembly 24. The turntable 26 receives intermediate stacks 18 (FIG. 2) from the stacker assembly 20. The turntable 26 rotates a main stack 28 through one-half of a revolution to offset the folded edges of an intermediate stack 18 from the folded edges of the next succeeding intermediate stack. This results in the main stack being relatively level and stable.

The turntable 26 has a rotatable circular platform 234 (FIG. 2). A plurality of upstanding side walls 236 and 238 (FIG. 3) are disposed on the platform 234. The side walls 236 and 238 engage a main stack 28 of signatures to hold the stack in position on the platform 234 during rotation of the platform.

A drive assembly 242 is (FIG. 8) connected to a central portion of the platform 234 (FIGS. 2 and 3). The drive assembly 242 is operable to rotate the platform 234 about a vertical axis which extends through the center of an intermediate stack 18 supported in the stacker assembly 20. Thus, the platform 234 is rotatable about a vertical central axis 244 (FIGS. 2 and 3) which extends through the center of the main stack 28 and through the center of the intermediate stack 18 supported by the stacker assembly 20 above the turntable 26.

The vertical central axis 244 of the circular turntable platform 234 is disposed midway between the circuitous paths 44 and 94 and midway between a pair of slats 34 disposed at the loading positions 58 and 98 (FIG. 3). The central axis 244 of the turntable 26 extends parallel to the side surfaces 152 and 172 (FIG. 7) on the side sections 148 and 168 of the jogger side plates 142 and 144. The central axis 244 of the turntable is disposed midway between the side surfaces 152 and 172 on the jogger side plates 142 and 144. In addition, the central axis 244 of the turntable 26 extends parallel to and is disposed midway between the side surfaces on the end sections 156 and 176 of the jogger side plates 142 and 144 (FIG. 7) and the side surfaces 190 and 196 on the jogger back plates 184 and 186.

The platform 234 has a flat circular upwardly facing side surface 248 which is disposed in a horizontal plane and extends parallel to the longitudinal axes of the slats 34 in the stacker assembly 20 (FIG. 2). The flat upper side surface 248 of the turntable 26 supports the main stack 28 of signatures for rotation about the central axis 244 of the turntable.

The drive assembly 242 is operable to rotate the turntable 26 about the central axis 244 to offset the folded edge portions of succeeding intermediate stacks 18 of signatures deposited on the main stack 28 of signatures on the turntable 26. To offset the folded edge portions of the intermediate stacks 18 of signatures relative to the main stack 28, the drive assembly 242 is operable to rotate the platform 234 through 180° immediately after one intermediate stack 18 of signatures is deposited on the turntable 26 and before the next succeeding intermediate stack is deposited on the turntable.

Although the drive assembly 242 (FIG. 8) could be constructed in such a manner as to sequentially rotate the turntable through 180° increments in the same direction, the drive assembly is constructed so as to sequentially rotate the turntable through 180° increments in opposite directions. Thus, the drive assembly 242 rotates the platform 234 in a clockwise direction (as viewed in FIG. 4) through 180° before one intermediate stack 18 of signatures is deposited on the platform. The drive assembly 242 then rotates the platform 234 through 180° in a counterclockwise direction (as viewed in FIG. 4) before the next succeeding intermediate stack 18 of signatures is deposited on the platform.

The turntable drive assembly 242 includes a cylindrical drive post 254 (FIG. 8) having a central axis which is coincident with the central axis 244 of the turntable 26. The drive post 254 is fixedly secured to the bottom of the platform 234. A helical cam groove 256 is formed in the drive post 254 and extends for 180° about the circumference of the drive post. The cam groove 256 has a central axis which is also coincident with the central axis 244 of the drive assembly 242.

A cylindrical cam follower 260 is mounted on a carriage 262 and extends into the helical cam groove 256. A plurality of guide rollers 264 on the carriage 262 engage linear vertical edge portions 266 and 268 on a pair of vertical guide bars 272 and 274 to guide movement of the carriage along the drive post 254. A piston and cylinder type motor 278 is connected with the carriage 262 and is operable to reciprocate the carriage 262 along the guide bars 272 and 274.

Figure 8:
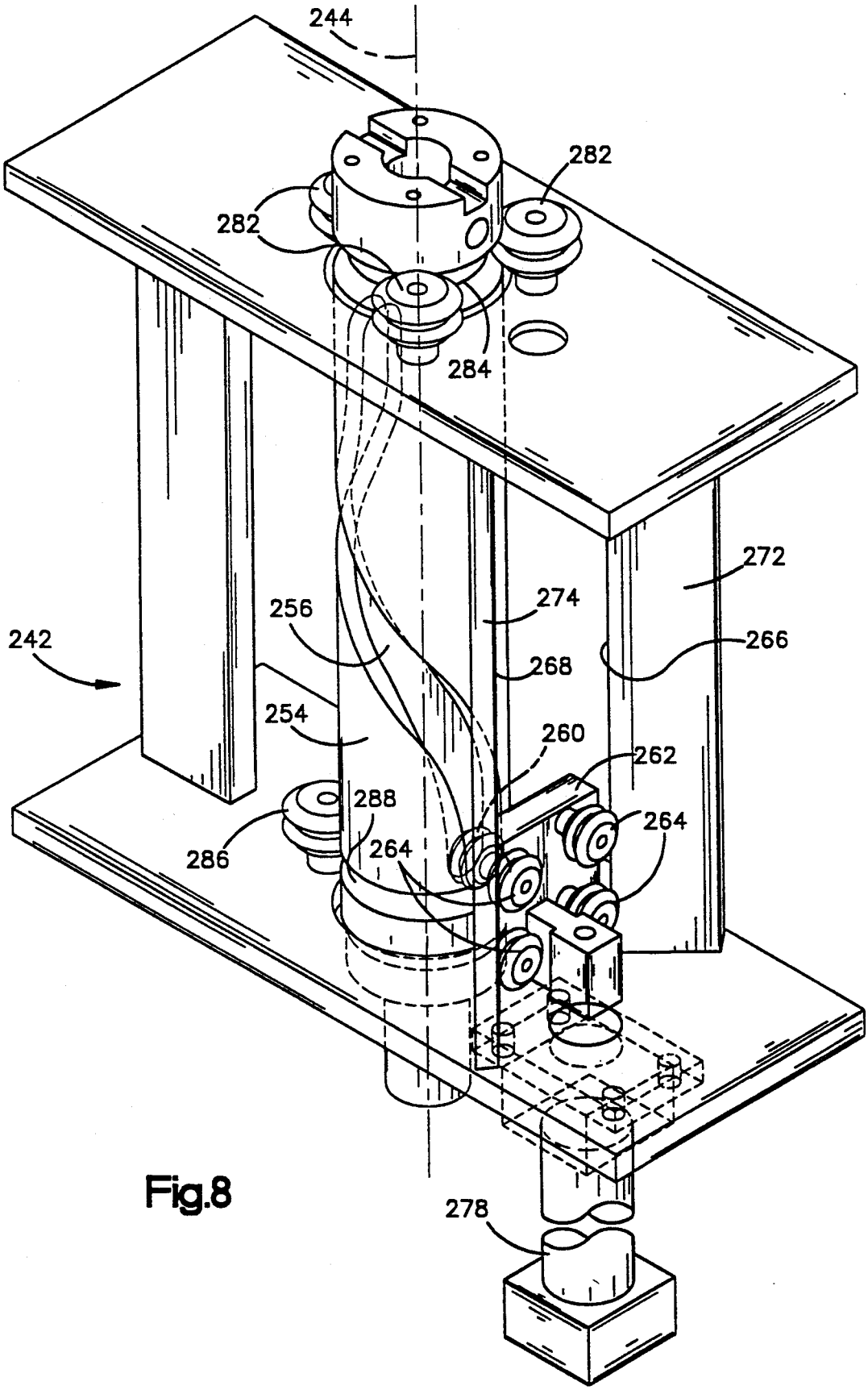
FIG. 8 is a schematic pictorial illustration of a turntable drive assembly.

The carriage 262 is moved vertically upwardly along a linear path from the lowered position of FIG. 8 upon operation of the motor 278. As the carriage 262 moves upwardly, the cam follower 260 cooperates with the helical cam groove 256 to rotate the drive post 254 through 180° about the central axis 244. After an intermediate stack 18 of signatures has been deposited on the turntable 26, the direction of operation of the motor 278 is reversed to move the carriage 262 and cam follower 260 downwardly along the drive post 254. As this occurs, the cooperation between the cam follower 260 and the helical cam groove 256 results in the drive post being rotated through 180° in the opposite direction.

A plurality of rollers 282 (FIG. 8) cooperate with an annular groove 284 formed in the upper end portion of the drive post 254 to hold the drive post against axial movement. Similarly, a plurality of rollers 286 cooperate with an annular groove 288 formed in the lower end portion of the drive post 254 to hold the drive post against axial movement.

In the illustrated embodiment of the invention, the drive post 254 is rotated by cooperation between a cam follower 260 and a helical groove 256 formed in the drive post. It is contemplated that a helical cam track could be provided on the outside of the drive post 254 and engaged by a suitable cam follower. In the illustrated embodiment of the invention, the helical cam groove 256 extends for 180° about the circumference of the drive post 254. It is contemplated that the cam groove 256 could be constructed in such a manner as to extend through 360° about the cam post 254. If this was done, the motor 278 would be operated to move the cam follower 260 along half of the length of the cam groove in order to rotate the drive post through 180° each time an intermediate stack 18 of signatures is deposited on the turntable 26.

It may be desired to eliminate the compensation for the thick folded edge portions of the signatures 12. In this situation, the turntable may be replaced by a stationary platform or the turntable drive assembly 242 may be temporarily rendered inactive.

Operation

During operation of the apparatus 10, the infeed conveyor 14 (FIG. 2) conducts a continuous stream 16 of signatures 12 to the stacker assembly 20 with folded edge portions of the signatures leading. As the signatures 12 enter the stacker assembly 20, the folded edge portions of the signatures impact against the end sections 156 and 176 (FIGS. 5B and 7) on the jogger side plates 142 and 144. Opposite ends of the signatures 12 are engaged by the side surfaces 152 and 172 on the jogger side plates 142 and 144. This aligns the incoming signatures 12 with a partially formed intermediate stack 18 (FIG. 2) of signatures supported on a pair of slats 34 at the loading positions 58 and 98 (FIG. 3).

The signatures 12 then move downwardly toward the upper end of the partially formed intermediate stack 18. As the signatures 12 move downwardly, the open trailing edge portions of the signatures engage the end sections 188 and 194 (FIG. 7) on the jogger back plates 184 and 186. The end sections 188 and 194 on the back plates 184 and 186 cause the signatures to move into firm abutting engagement with the end sections 156 and 176 on the jogger side plates 142 and 144.

While an intermediate stack 18 of signatures having a desired height is being accumulated on a pair of slats 34 in the stacker assembly 20 (FIG. 3), the turntable drive assembly 242 rotates the turntable platform 234 through 180°. Thus, the motor 278 (FIG. 8) is operated to raise the carriage 262 from the lower end of the drive post 254 to the upper end of the drive post. This rotates the turntable platform 234 through 180° in a counterclockwise direction (as viewed in FIG. 1).

Rotation of the turntable platform 234 results in the folded edge portions of the immediately preceding intermediate stack 18 of signatures being moved from a position disposed to the left (as viewed in FIG. 2) of the central axis 244 of the turntable 26 to a position to the right of the turntable axis. Thus, the folded edge portions of the uppermost intermediate stack 18 of signatures on the main stack 28 are moved from a position directly beneath the folded edge portions of the intermediate stack 18 being accumulated in the stacker assembly 20 to a position to the right (as viewed in FIG. 2) of the axis 244 and immediately beneath the open edge portions of the signatures being accumulated in the intermediate stack 18 in the stacker assembly 20.

While the signatures 12 are being accumulated in the stacker assembly 20 to form the intermediate stack 18, the side sections 148 and 168 (FIGS. 5B and 7) of the jogger side plates 142 and 144 are continuously impacted against opposite ends of the immediate stack 18 of signatures by the eccentric drive assemblies 202 and 204. The en sections 156 and 176 on the jogger side plates 142 and 144 are continuously impacted against the folded edges of the signatures 12 on one side of the intermediate stack 18. Similarly, the end sections 188 and 194 of the jogger back plates 184 and 186 are continuously impacted against the open edges of the signatures 12 on an opposite side of the intermediate stack 18. By continuously jogging the signatures 12 in the intermediate stack 18, the edge portions of the signatures are accurately aligned with each other to form an intermediate stack with well defined and relatively smooth side and end surfaces.

Once an intermediate stack 18 of a desired size has been accumulated on a pair of slats 34 at the loading positions 58 and 98, the single revolution clutch 132 in the main drive system 128 is engaged. The main drive system 128 then operates the drive assembly 38 to index the slats 34 of the first plurality 32 of slats in a clockwise direction along the first circuitous path 44 (FIG. 1). At the same time, the main drive system 128 operates the drive assembly 40 to index the slats 34 in the second plurality 36 of slats in a counterclockwise direction along the second circuitous path 94.

As the slats 34 are moved downwardly from the loading positions 58 and 98, the front side surfaces 66 of the slats are tipped downwardly and moved sidewardly to release the intermediate stack 18 of signatures for downward movement toward the turntable 26. As the intermediate stack 18 of signatures begins to move downwardly relative to the slats 34, the jogger assembly 24 continuously jogs the ends and sides of the intermediate stack to maintain the signatures 12 in alignment with each other. Thus, the jogger assembly 24 functions to promote alignment of the signatures 12 from the time the signatures are fed into the upper portion of the stacker assembly 20, through the formation of an intermediate stack 18, and through at least a portion of the depositing of the intermediate stack on the turntable 26.

As the slats 34 move downwardly and sidewardly away from the loading positions 58 and 98, the next succeeding slats 34 move downwardly from the standby positions 62 and 102. Thus, the main drive system 128 is operable to quickly move the slats 34 downwardly from their standby positions 62 and 102 to a position in which the front surfaces 66 of the slats are immediately beneath the standby positions 62 and 102 and are disposed in a common horizontal plane. Since the slats 34 are relatively long and narrow, the slats can easily move into the stream 16 of signatures with minimal interference.

As the downward movement of the slats 34 along the inner runs of the first and second circuitous paths 44 and 94 is continued, the downwardly facing rear sides of the slats engage the last signature 12 being fed onto the intermediate stack 18. The downwardly moving slats 34 propel this last signature downwardly toward the intermediate stack 18. At the same time, the horizontal upper sides 66 of the slats 34 move into position to receive the next succeeding signature in the stream of signatures. During continued downward movement of the slats 34 away from the standby positions 62 and 102 toward the loading positions 58 and 98, a few signatures are accumulated on the slats 34.

The slats 34 are quickly moved to the loading positions 58 and 98 with their upwardly facing front side surfaces 66 disposed in a common horizontal plane. The operation of the main drive system 128 is then interrupted and the slats 34 remain stationary at the loading positions 58 and 98. As a pair of slats in the first and second pluralities 32 and 36 of slats are moved along the circuitous paths 44 and 94 to the loading positions 58 and 98, the next succeeding slats are moved along the circuitous paths 44 and 94 from the intermediate positions 60 and 100 to the standby positions 62 and 102.

As soon as an intermediate stack 18 of signatures has been deposited on the main stack 28 of signatures on the turntable 26, the turntable drive assembly 242 is again operated. The turntable platform 234 is then rotated back through 180° in a clockwise direction (as viewed in FIG. 1). Thus, the turntable drive motor 278 (FIG. 8) moves the cam follower 260 back downwardly along the helical cam groove 256 to rotate the platform 234 in a clockwise direction (as viewed in FIGS. 1 and 4). This results in the folded edge portions of succeeding intermediate stacks 18 of signatures accumulating in the main stack 28 of signatures with their folded edge portions offset by 180° relative to each other.

Conclusion

The present invention relates to a new and improved apparatus 10 for use in stacking signatures 12. The apparatus 10 includes first and second pluralities 32 and 36 of longitudinally extending slats 34. One of the slats 34 of the first plurality 32 of slats cooperates with one of the slats of the second plurality 36 of slats to support an intermediate stack 18 of signatures. The slats 34 have longitudinal axes which are maintained parallel to each other and horizontal during movement of the slats along a pair of spaced apart circuitous paths 44 and 94 by a pair of drive assemblies 38 and 40.

A jogger assembly 24 is operable to jog a stack 18 of signatures supported by the slats 34 in the stacker assembly 20. The jogger assembly 24 has jogger plates 142, 144, 184 and 186 which are enclosed by the circuitous paths 44 and 94 along which the slats 34 move. The jogger plates 142, 144, 184 and 186 and slats 34 are disposed above a receiving platform, which may be the turntable 26.

The turntable 26 includes a platform 234 having a horizontal upper surface 248 which is parallel to longitudinal axes of the slats 34 and perpendicular to side surfaces 152, 158, 172, 178, 190 and 196 of the jogger plates 142, 144, 184, and 186. Each time an intermediate stack 18 of signatures 12 is transferred from the stacker assembly 20 to the turntable 26, the platform 234 on which the main stack 28 of signatures is disposed is rotated through one-half of a revolution. Rotation of the platform 234 offsets the relatively thick folded edge portions of signatures on the turntable 26 relative to the folded edge portions of the next succeeding intermediate stack 18 of signatures. The platform 234 is rotated by a drive assembly 242 which includes a cam follower 260 which is moved vertically relative to a helical cam 256 to rotate the platform.

Having described the invention, the following is claimed:

1. An apparatus for use in stacking signatures, said apparatus comprising first and second pluralities of longitudinally extending signature support elements having longitudinal axes extending transversely to a vertical plane, first drive means for moving said first plurality of signature support elements along a first circuitous path, second drive means for moving said second plurality of signature support elements along a second circuitous path which is separate from the first circuitous path, said first and second drive means being disposed on a first side of the vertical plane, each signature support element of said first and second pluralities of signature support elements extending through the vertical plane and having surface means for engaging a lower side of a stack of signatures to support the stack of signatures with the stack of signatures entirely disposed on the second side of the vertical plane, and jogger means disposed on the second side of the vertical plane for jogging the stack of signatures while the stack of signatures is supported by one of the signature support elements of said first plurality of signature support elements and by one of the signature support elements of said second plurality of signature support elements.

2. An apparatus as set forth in claim 1 wherein said jogger means includes first and second jogger plates which are engageable with a stack of signatures and means for moving said first and second jogger plates relative to the stack of signatures, said first circuitous path along which said first plurality of signature support elements is moved by said first drive means extends around said first jogger plate, said second circuitous path along which said second plurality of signature support elements is moved by said second drive means extends around said second jogger plate.

3. An apparatus as set forth in claim 2 wherein said first jogger plate has first side surface means for engaging a first end portion of a stack of signatures, said signature support elements of said first plurality of signature support elements having longitudinal axes which are maintained in a parallel relationship with said first side surface means throughout movement of said first plurality of signature support elements along the first circuitous path, said second jogger plate having second surface means for engaging an end portion of a stack of signatures opposite from said first end portion, said signature support elements of said second plurality of signature support elements having longitudinal axes which are maintained in parallel relationship with said second side surface means throughout movement of said second plurality of signature support elements along the second circuitous path.

4. An apparatus as set forth in claim 2 wherein said first jogger plate has first surface means for engaging a first portion of a stack of signatures, said signature support elements of said first plurality of signature support elements having longitudinal axes which are maintained in a perpendicular relationship with said first surface means throughout movement of said first plurality of signature support elements along the first circuitous path, said second jogger plate having second surface means for engaging a second portion of the stack of signatures, said signature support elements having longitudinal axes which are maintained in a perpendicular relationship with said second surface means during movement of said second plurality of signature support elements along the second circuitous path.

5. An apparatus as set forth in claim 2 wherein said first jogger plate includes a first section which extends parallel to the longitudinal axes of said first plurality of signature support elements and a second section which extends perpendicular to the longitudinal axes of said first plurality of signature support elements, said first section of said first jogger plate being engageable with a first end portion of a stack of signatures, said second section of said first jogger plate being engageable with a first side portion of the stack of signatures, said second jogger plate including a first section which extends parallel to the longitudinal axes of said second plurality of signature support elements and a second section which extends perpendicular to the longitudinal axes of said second plurality of signature support elements, said first section of said second jogger plate being engageable with a second end portion of the stack of signatures opposite from the first end portion of the stack of signatures, said second section of said second jogger plate being engageable with the first side portion of the stack of signatures.

6. An apparatus for use in stacking signatures, said apparatus comprising first and second pluralities of longitudinally extending signature support elements having longitudinal axes extending transversely to a vertical plane, first drive means for moving said first plurality of signature support elements along a first circuitous path, second drive means for moving said second plurality of signature support elements along a second circuitous path which is separate from the first circuitous path, said first and second drive means being disposed on a first side of the vertical plane, each signature support element of said first and second pluralities of signature support elements extending through the vertical plane and having surface means for engaging a lower side of a stack of signatures to support the stack of signatures with the stack of signatures entirely disposed on the second side of the vertical plane, and turntable means disposed beneath said first and second pluralities of signature support elements for sequentially receiving stacks of signatures from said first and second pluralities of signature support elements, said turntable means including a support platform and third drive means for rotating said support platform about a vertical axis which is disposed on the second side of the vertical plane at a location midway between the first and second circuitous paths.

7. An apparatus as set forth in claim 6 wherein said third drive means includes a helical cam connected with said support platform and having a central axis which is coincident with the vertical axis about which said support platform is rotatable, a cam follower disposed in engagement with said helical cam, and motor means for moving said cam follower along a vertical path relative to said helical cam to rotate said support platform.

8. An apparatus as set forth in claim 7 wherein said third drive means further includes a carriage connected with said cam follower and said motor means, and a linear vertical guide track, said carriage including means which engages said guide track to guide vertical movement of said carriage along said helical cam.

9. An apparatus for use in stacking signatures, said apparatus comprising first and second pluralities of longitudinally extending signature support elements having longitudinal axes extending transversely to a vertical plane, first drive means for moving said first plurality of signature support elements along a first circuitous path, said first drive means being operable to move said first plurality of signature support elements along the first circuitous path with the longitudinal central axes of the signature support elements of said first plurality of signature support elements in a parallel relationship throughout movement of said first plurality of signature support elements along the first circuitous path, and second drive means for moving said second plurality of signature supports elements along a second circuitous path which is separate from the first circuitous path, said second drive means moves said second plurality of signature support elements along the second circuitous path with the longitudinal central axes of the signature support elements of said second plurality of signature support elements in a parallel relationship throughout movement of said second plurality of signature support elements along the second circuitous path, said first and second drive means being disposed on a first side of the vertical plane, each signature support element of said first and second pluralities of signature support elements extending through the vertical plane and having surface means for engaging a lower side of a stack of signatures to support the stack of signatures with the stack of signatures entirely disposed on the second side of the vertical plane.

10. An apparatus as set forth in claim 9 further including platform means disposed beneath said first and second pluralities of signature support elements for receiving stacks of signatures from said first and second pluralities of signature support elements, said platform means having flat upper side surface means for supporting a stack of signatures received from said first and second pluralities of signature support elements, said first and second pluralities of signature support elements having longitudinal axes which are continuously maintained parallel to said flat upper side surface means of said platform means during movement of said first plurality of signature support elements along said first circuitous path and during movement of said second plurality of signature support elements along said second circuitous path.

11. An apparatus as set forth in claim 9 further including jogger means disposed on the second side of the vertical plane for jogging the stack of signatures while the stack of signatures is supported by one of the signature support elements of said first plurality of signature support elements and by one of the signature support elements of said second plurality of signature support elements.

12. An apparatus as set forth in claim 11 wherein said jogger means includes first and second jogger plates which are engageable with a stack of signatures and means for moving said first and second jogger plates relative to the stack of signatures, said first circuitous path along which said first plurality of signature support elements is moved by said first drive means extends around said first jogger plate, said second circuitous path along which said second plurality of signature support elements is moved by said second drive means extends around said second jogger plate.

13. An apparatus as set forth in claim 11 wherein said jogger means includes first and second jogger plates and means for moving said first and second jogger plates relative to a stack of signatures, said first jogger plate having first side surface means for engaging a first end portion of a stack of signatures, said signature support elements of said first plurality of signature support elements having longitudinal axes which are maintained in a parallel relationship with said first side surface means throughout movement of said first plurality of signature support elements along the first circuitous path, said second jogger plate having second surface means for engaging an end portion of a stack of signatures opposite from said first end portion, said signature support elements of said second plurality of signature support elements having longitudinal axes which are maintained in a parallel relationship with said second side surface means throughout movement of said second plurality of signature support elements along the second circuitous path.

14. An apparatus as set forth in claim 11 wherein said jogger means includes first and second jogger plates and means for moving said first and second jogger plates relative to a stack of signatures, said first jogger plate having first surface means for engaging a first portion of a stack of signatures, said signature support elements of said first plurality of signature support elements having longitudinal axes which are maintained in a perpendicular relationship with said first surface means throughout movement of said first plurality of signature support elements along the first circuitous path, said second jogger plate having second surface means for engaging a second portion of the stack of signatures, said signature support elements having longitudinal axes which are maintained in a perpendicular relationship with said second surface means during movement of said second plurality of signature support elements along the second circuitous path.

15. An apparatus as set forth in claim 11 wherein said jogger means includes first and second jogger plates and means for moving said first and second jogger plates relative to a stack of signatures, said first jogger plate includes a first section which extends parallel to the longitudinal axes of said first plurality of signature support elements and a second section which extends perpendicular to the longitudinal axes of said first plurality of signature support elements, said first section of said first jogger plate being engageable with a first end portion of a stack of signatures, said second section of said first jogger plate being engageable with a first side portion of the stack of signatures, said second jogger plate including a first section which extends parallel to the longitudinal axes of said second plurality of signature support elements and a second section which extends perpendicular to the longitudinal axes of said second plurality of signature support elements, said first section of said second jogger plate being engageable with a second end portion of the stack of signatures opposite from the first end portion of the stack of signatures, said second section of said second jogger plate being engageable with the first side portion of the stack of signatures.

16. An apparatus as set forth in claim 9 further including turntable means disposed beneath said first and second pluralities of signature support elements for sequentially receiving stack of signatures from said first and second pluralities of signature support elements, said turntable means including a support platform and third drive means for rotating said support platform about a vertical axis which is disposed on the second side of the vertical plane at a location midway between the first and second circuitous paths.

17. An apparatus as set forth in claim 16 wherein said third drive means includes a helical cam connected with said support platform and having a central axis which is coincident with the vertical axis about which said support platform is rotatable, a cam follower disposed in engagement with said helical cam, and motor means for moving said cam follower along a vertical path relative to said helical cam to rotate said support platform.

18. An apparatus as set forth in claim 17 wherein said third drive means further includes a carriage connected with said cam follower and said motor means, and a linear vertical guide track, said carriage including means which engages said guide track to guide vertical movement of said carriage along said helical cam.

19. An apparatus for use in stacking signatures, said apparatus comprising first and second pluralities of longitudinally extending signature support elements having longitudinal axes extending transversely to a vertical plane, first drive means for moving said first plurality of signature support elements along a first circuitous path, second drive means for moving said second plurality of signature supports elements along a second circuitous path which is separate from the first circuitous path, said first and second drive means being disposed on a first side of the vertical plane, each signature support element of said first and second pluralities of signature support elements extending through the vertical plane and having surface means for engaging a lower side of a stack of signatures to support the stack of signatures with the stack of signatures entirely disposed on the second side of the vertical plane, said first and second circuitous paths have vertical portions along which said signature support elements are downwardly movable by said first and second drive means, said vertical portions of said first and second circuitous paths being spaced apart by a distance which is less than the distance between opposite end portions of the stack of signatures, and jogger means for jogging a stack of signatures supported by one of the signature support elements of said first plurality of signature support elements and one of the signature support elements of said second plurality of signature support elements as said one signature support element of said first plurality of signature support elements and said one signature support element of said second plurality of signature support elements move along said vertical portions of said first and second circuitous paths, said jogger means including a pair of parallel plate sections which are engageable with the opposite end portions of the stack of signatures and are spaced apart by a horizontal distance which is greater than the horizontal distance between said vertical portions of said first and second circuitous paths.

20. An apparatus as set forth in claim 19 wherein said plate sections of said jogger means have flat major side surfaces which extend perpendicular to the vertical plane and are entirely disposed on the second side of the vertical plane.

21. An apparatus for use in stacking signatures, said apparatus comprising first and second pluralities of longitudinally extending signature support elements, one of said signature support elements of said first plurality of signature support elements cooperating with one of said signature support elements of said second plurality of signature support elements to support a stack of signatures, jogger means for jogging a stack of signatures supported by one of said signature support elements of said first plurality of signature support elements and one of said signature support elements of said second plurality of signature support elements, said jogger means including a first jogger plate engageable with a first end portion of a stack of signatures and a second jogger plate engageable with a second end portion of the stack of signatures, first drive means for moving said first plurality of signature support elements along a first circuitous path which extends around said first jogger plate, and second drive means for moving said second plurality of signature support elements along a second circuitous path which extends around said second jogger plate.

22. An apparatus as set forth in claim 21 wherein said first jogger plate has a flat side surface which is engageable with the first end portion of the stack of signatures, said second jogger plate having a flat side surface which is engageable with the second end portion of the stack of signatures, said signature support elements of said first plurality of signature support elements having longitudinal axes which extend parallel to said side surface of said first jogger plate throughout movement of said signature support elements of said first plurality of signature support elements along the first circuitous path, said signature support elements of said second plurality of signature support elements having longitudinal axes which extend parallel to said side surface of said second jogger plate throughout movement of signature support elements of said second plurality of signature support elements along the second circuitous path.

23. An apparatus as set forth in claim 21 wherein said first circuitous path includes a vertical portion along which said signature support elements of said first plurality of signature support elements are moved by said first drive means, said second circuitous path including a vertical portion along which said signature support elements of said second plurality of signature support elements are moved by said second drive means, said vertical portions of said first and second circuitous paths being at least partially disposed between said first and second jogger plates.

24. An apparatus as set forth in claim 21 wherein said first circuitous path includes a first portion along which said signature support elements of said first plurality of signature support elements are moved upwardly and a second portion along which said signature support elements of said first plurality of signature support elements are moved downwardly, said first portion of said first circuitous path being disposed on a first side of said first jogger plate and said second portion of said first circuitous path being disposed on a second side of said first jogger plate, said second circuitous path including a first portion along which said signature support elements of said second plurality of signature support elements are moved upwardly and a second portion along which said signature support elements of said second plurality of signature support elements are moved downwardly, said first portion of said second circuitous path being disposed on a first side of said second jogger plate and said second portion of said second circuitous path being disposed on a second side of said second jogger plate.

25. An apparatus as set forth in claim 21 wherein said first jogger plate includes a first section which extends parallel to the longitudinal axes of said first plurality of signature support elements and a second section which extends perpendicular to the longitudinal axes of said first plurality of signature support elements, said first section of said first jogger plate being engageable with the first end portion of the stack of signatures, said second section of said first jogger plate being engageable with a side portion of the stack of signatures, said second jogger plate including a first section which extends parallel to the longitudinal axes of said second plurality of signature support elements and a second section which extends perpendicular to the longitudinal axes of said second plurality of signature support elements, said first section of said second jogger plate being engageable with the second end portion of the stack of signatures, said second section of said second jogger plate being engageable with the side portion of the stack of signatures.

26. An apparatus as set forth in claim 21 wherein each of said signature support elements of said first plurality of signature support elements has a first end portion connected with said first drive means and a free end portion which is opposite from said first end portion, said jogger means including a third jogger plate which is disposed outwardly from the free end portions of said signature support elements of said first plurality of signature support elements and is engageable with a side portion of the stack of signatures, each of said signature support elements of said second plurality of signature support elements having a first end portion connected with said second drive means and a free end portion which is opposite from said first end portion, said jogger means including a fourth jogger plate which is disposed outwardly from the free end portions of said signature support elements of said second plurality of signature support elements and is engageable with the side portion of the stack of signatures.

27. An apparatus for use in stacking signatures, said apparatus including first and second wheels rotatable about parallel axes disposed in a first plane, a first flexible drive element disposed in engagement with said first and second wheels, a first plurality of longitudinally extending signature support elements connected in a cantilevered relationship with said first flexible drive element, each of said signature support elements of said first plurality of signature support elements having a longitudinal axis which extends through a first end portion connected with said first flexible drive element and a free end portion disposed outwardly from said first flexible drive element in a direction parallel to the axes of rotation of said first and second wheels, each of said signature support elements of said first plurality of signature support elements being moveable along a first circuitous path by said first flexible drive element with the longitudinal axis of each signature support element of said first plurality of signature support elements extending parallel to the first plane containing the axes of rotation of said first and second wheels, third and fourth wheels rotatable about parallel axes disposed in a second plane, a second flexible drive element disposed in engagement with said third and fourth wheels, a second plurality of longitudinally extending signature support elements connected in a cantilevered relationship with said second flexible drive element, each of said signature support elements of said second plurality of signature support elements having a longitudinal axis which extends through a first end portion connected with said second flexible drive element and a free end portion disposed outwardly from said second flexible drive element in a direction parallel to the axes of rotation of said third and fourth wheels, each of said second plurality of signature support elements being moveable along a second circuitous path by said second flexible drive element with a longitudinal axis of each signature support element of said second plurality of signature support elements extending parallel to the second plane containing the axes of rotation of said third and fourth wheels, said first and second circuitous paths having vertical portions along which said signature support elements are movable by said first and second flexible drive elements, said signature support elements of said first plurality of signature support elements being spaced apart from said signature support elements of said second plurality of signature support elements by a distance which is less than the distance between opposite end portions of the stack of signatures to enable the stack of signatures to be supported on one of the signature support elements of the first plurality of signature support elements and one of the signature support elements of the second plurality of signature support elements when the one signature support element of the first plurality of signature support elements is disposed along the vertical portion of the first circuitous path and the one signature support element of the second plurality of signature support elements is disposed along the vertical portion of the second circuitous path.

28. An apparatus as set forth in claim 27 wherein the vertical portions of said first and second circuitous paths are spaced apart by a distance which is less than the distance between the opposite end portions of the stack of signatures.

29. An apparatus as set forth in claim 27 wherein the longitudinal axes of said signature support elements of said first plurality of signature support elements extend parallel to the axes of rotation of said first and second wheels, and the longitudinal axes of said signature support elements of said second plurality of signatures support elements extend parallel to the axes of rotation of said third and fourth wheels.

30. An apparatus as set forth in claim 27 wherein a stack of signatures supported by one of the signature support elements of said first plurality of signature support elements and by one of the signature support elements of said second plurality of signature support elements extends through the first plane containing the axes of rotation of said first and second wheels and the second plane containing the axes of rotation of said third and fourth wheels.

31. An apparatus as set forth in claim 27 further including jogger means for jogging a stack of signatures supported on one of the signature support elements of said first plurality of signature support elements and one of the signature support elements of said second plurality of signature support elements.

32. An apparatus for use in stacking signatures, said apparatus comprising first and second pluralities of longitudinally extending signature support elements, one of said signature support elements of said first plurality of signature support elements cooperating with one of said signature support elements of said second plurality of signature support elements to support a stack of signatures, and turntable means disposed beneath said first and second pluralities of signature support elements for sequentially receiving stacks of signatures from said first and second pluralities of signature support elements, said turntable means including a support platform and turntable drive means for rotating said support platform about a vertical axis which is disposed midway between a longitudinal axis of said one of said signature support elements of said first plurality of signature support elements and a longitudinal axis of said one of said signature support elements of said second plurality of signature support elements, said turntable drive means including a helical cam connected with said platform and having a central axis which is coincident with the vertical axis about which said support platform is rotatable, a cam follower disposed in engagement with said helical cam, and motor means for moving said cam follower along a vertical path relative to said helical cam to rotate said support platform.

33. An apparatus as set forth in claim 32 wherein said turntable drive means further includes a carriage connected with said cam follower and said motor means, a linear vertical guide track, and means connected with said carriage and engageable with said guide track to guide vertical movement of said carriage along said guide track.

34. An apparatus as set forth in claim 32 wherein said support platform has a flat upwardly facing side surface upon which a stack of signatures is received from said first and second pluralities of signature support elements, said signature support elements of said first and second pluralities of signature support elements having longitudinal axes which are continuously maintained parallel to said flat upwardly facing side surface of said support platform.

35. An apparatus as set forth in claim 32 wherein said turntable drive means includes a drive member connected with and extending downwardly from said platform, said helical cam being fixedly connected with said drive member and extending between upper and lower end portions of said drive member.

36. An apparatus as set forth in claim 32 further including jogger means disposed above said platform for jogging a stack of signatures while the stack of signatures is supported above said platform by said one of said signature support elements of said first plurality of signature support elements and by said one of said signature support elements of said second plurality of signature support elements, said jogger means including a first jogger plate disposed above said platform and engageable with a first end portion of a stack of signatures, a second jogger plate disposed above said platform and engageable with a second end portion of a stack of signatures, and jogger plate drive means for moving said first and second jogger plates relative to the stack of signatures, said one of said signature support elements of said first plurality of signature support elements and said one of said signature support elements of said second plurality of signature support elements being disposed between said jogger plates.

37. An apparatus as set forth in claim 36 wherein said support platform has an upwardly facing side surface upon which a stack of signatures is received from said first and second pluralities of signature support elements, said first jogger plate having a side surface which is engageable with the first end portion of the stack of signatures and which extends perpendicular to the upwardly facing side surface of said support platform, said second jogger plate having a side surface which is engageable with the second end portion of the stack of signatures and which extends perpendicular to the upwardly facing side surface of said platform, said first plurality of signature support elements having longitudinal axes which extend parallel to the side surface of said first jogger plate said second plurality of signature support elements having longitudinal axes which extend parallel to the side surface of said second jogger plate.

38. An apparatus for use in stacking signatures, said apparatus comprising first and second pluralities of longitudinally extending signature support elements having parallel longitudinal central axes, first drive means for moving said first plurality of signature support elements along a first circuitous path with the longitudinal central axes of the signature support elements of said first plurality of signature support elements in a parallel relationship throughout movement of said first plurality of signature support elements along the first circuitous path, and second drive means for moving said second plurality of signature supports elements along a second circuitous path with the longitudinal central axes of the signature support elements of said second plurality of signature support elements in a parallel relationship with the longitudinal central axes of the signature support elements of said first plurality of signature support elements throughout movement of said second plurality of signature support elements along the second circuitous path, each signature support element of said first and second pluralities of signature support elements having surface means for engaging a lower side of a stack of signatures to support the stack of signatures with the stack of signatures in engagement with a signature support element of the first plurality of signature support elements and a signature support element of the second plurality of signature support elements.

39. An apparatus as set forth in claim 38 further including jogger means for jogging the stack of signatures while the stack of signatures is supported by one of the signature support elements of said first plurality of signature support elements and by one of the signature support elements of said second plurality of signature support elements.

40. An apparatus as set forth in claim 39 wherein said jogger means includes first and second jogger plates which are engageable with a stack of signatures and means for moving said first and second jogger plates relative to the stack of signatures, said first circuitous path along which said first plurality of signature support elements is moved by said first drive means extends around said first jogger plate, said second circuitous path along which said second plurality of signature support elements is moved by said second drive means extends around said second jogger plate.

41. An apparatus as set forth in claim 39 wherein said jogger means includes first and second jogger plates and means for moving said first and second jogger plates relative to a stack of signatures, said first jogger plate having first side surface means for engaging a first end portion of a stack of signatures, said signature support elements of said first plurality of signature support elements having longitudinal axes which are maintained in a parallel relationship with said first side surface means throughout movement of said first plurality of signature support elements along the first circuitous path, said second jogger plate having second surface means for engaging an end portion of a stack of signatures opposite from said first end portion, said signature support elements of said second plurality of signature support elements having longitudinal axes which are maintained in parallel relationship with said second side surface means throughout movement of said second plurality of signature support elements along the second circuitous path.

42. An apparatus as set forth in claim 39 wherein said jogger means includes first and second jogger plates and means for moving said first and second jogger plates relative to a stack of signatures, said first jogger plate having first surface means for engaging a first portion of a stack of signatures, said signature support elements of said first plurality of signature support elements having longitudinal axes which are maintained in a perpendicular relationship with said first surface means throughout movement of said first plurality of signature support elements along the first circuitous path, said second jogger plate having second surface means for engaging a second portion of the stack of signatures, said signature support elements having longitudinal axes which are maintained in a perpendicular relationship with said second surface means during movement of said second plurality of signature support elements along the second circuitous path.

43. An apparatus as set forth in claim 39 wherein said jogger means includes first and second jogger plates and means for moving said first and second jogger plates relative to a stack of signatures, said first jogger plate having a first section which extends parallel to the longitudinal axes of said first plurality of signature support elements and a second section which extends perpendicular to the longitudinal axes of said first plurality of signature support elements, said first section of said first jogger plate being engageable with a first end portion of a stack of signatures, said second section of said first jogger plate being engageable with a first side portion of the stack of signatures, said second jogger plate including a first section which extends parallel to the longitudinal axes of said second plurality of signature support elements and a second section which extends perpendicular to the longitudinal axes of said second plurality of signature support elements, said first section of said second jogger plate being engageable with a second end portion of the stack of signatures opposite from the first end portion of the stack of signatures, said second section of said second jogger plate being engageable with the first side portion of the stack of signatures.

44. An apparatus as set forth in claim 38 further including turntable means disposed beneath said first and second pluralities of signature support elements for sequentially receiving stacks of signatures from said first and second pluralities of signature support elements, said turntable means including a support platform and third drive means for rotating said support platform about a vertical axis which extends between the first and second circuitous paths.

45. An apparatus as set forth in claim 44 wherein said third drive means includes a helical cam connected with said support platform and having a central axis which is coincident with the vertical axis about which said support platform is rotatable, a cam follower disposed in engagement with said helical cam, and motor means for moving said cam follower along a vertical path relative to said helical cam to rotate said support platform.

46. An apparatus as set forth in claim 45 wherein said third drive means further includes a carriage connected with said cam follower and said motor means, and a linear vertical guide track, said carriage including means which engages said guide track to guide vertical movement of said carriage along said helical cam.

47. An apparatus as set forth in claim 38 further including a platform disposed beneath said first and second pluralities of signature support elements for receiving stacks of signatures from said first and second pluralities of signature support elements, said platform having flat upper side surface means for supporting a stack of signatures received from said first and second pluralities of signature support elements, said first and second pluralities of signature support element shaving longitudinal axes which are continuously maintained parallel to said flat upper side surface means of said platform during movement of said first plurality of signature support elements along said first circuitous path and during movement of said second plurality of signature support elements along said second circuitous path.

48. An apparatus as set forth in claim 38 wherein said first drive means include a first flexible drive element which is movable along the first circuitous path, each signature support element of said first plurality of signature support elements being connected in a cantilevered relationship with said first flexible drive element, said second drive means including a second flexible drive element which is movable along the second circuitous path, each signature support element of said second plurality of signature support elements being connected in a cantilevered relationship with said second flexible drive element.

49. An apparatus as set forth in claim 38 wherein said first and second circuitous paths have vertical portions along which said signature support elements are downwardly movable by said first and second drive means, said vertical portions of said first and second circuitous paths being spaced apart by a distance which is less than the distance between opposite end portions of the stack of signatures.

50. An apparatus as set forth in claim 49 further including jogger means for jogging a stack of signatures supported by one of the signature support elements of said first plurality of signature support elements and one of the signature support elements of said second plurality of signature support elements as said one signature support element of said first plurality of signature support elements and said one signature support element of said second plurality of signature support elements move along said vertical portions of said first and second circuitous paths.

51. An apparatus for use in stacking signatures, said apparatus comprising first and second pluralities of longitudinally extending signature support elements, first drive means for moving said first plurality of signature support elements along a first circuitous path, second drive means for moving said second plurality of signature supports elements along a second circuitous path which is separate from the first circuitous path, each signature support element of said first and second pluralities of signature support elements having surface means for engaging a lower side of a stack of signatures to support the stack of signatures with the stack of signatures in engagement with a signature support element of the first plurality of signature support elements and a signature support element of the second plurality of signature support elements, and a platform disposed beneath said first and second pluralities of signature support elements for receiving stacks of signatures from said first and second pluralities of signature support elements, said platform having flat upper side surface means for supporting a stack of signatures received from said first and second pluralities of signature support elements, said first and second pluralities of signature support elements having longitudinal axes which are continuously maintained parallel to said flat upper side surface means of said platform during movement of said first plurality of signature support elements along said first circuitous path and during movement of said second plurality of signature support elements along said second circuitous path.

52. An apparatus as set forth in claim 51 further including jogger means for jogging the stack of signatures while the stack of signatures is supported by one of the signature support elements of said first plurality of signature support elements and by one of the signature support elements of said second plurality of signature support elements.

53. An apparatus as set forth in claim 52 wherein said jogger means includes first and second jogger plates which are engageable with a stack of signatures and means for moving said first and second jogger plates relative to the stack of signatures, said first circuitous path along which said first plurality of signature support elements is moved by said first drive means extends around said first jogger plate, said second circuitous path along which said second plurality of signature support elements is moved by said second drive means extends around said second jogger plate.

54. An apparatus as set forth in claim 52 wherein said jogger means includes first and second jogger plates which are engageable with a stack of signatures and means for moving said first and second jogger plates relative to the stack of signatures, said first jogger plate having first side surface means for engaging a first end portion of a stack of signatures, said signature support elements of said first plurality of signature support elements having longitudinal axes which are maintained in a parallel relationship with said first side surface means throughout movement of said first plurality of signature support elements along the first circuitous path, said second jogger plate having second surface means for engaging an end portion of a stack of signatures opposite from said first end portion, said signature support elements of said second plurality of signature support elements having longitudinal axes which are maintained in parallel relationship with said second side surface means throughout movement of said second plurality of signature support elements along the second circuitous path.

55. An apparatus as set forth in claim 52 wherein said jogger means includes first and second jogger plates which are engageable with a stack of signatures and means for moving said first and second jogger plates relative to the stack of signatures, said first jogger plate having first surface means for engaging a first portion of a stack of signatures, said signature support elements of said first plurality of signature support elements having longitudinal axes which are maintained in a perpendicular relationship with said first surface means throughout movement of said first plurality of signature support elements along the first circuitous path, said second jogger plate having second surface means for engaging a second portion of the stack of signatures, said signature support elements having longitudinal axes which are maintained in a perpendicular relationship with said second surface means during movement of said second plurality of signature support elements along the second circuitous path.

56. An apparatus as set forth in claim 52 wherein said jogger means includes first and second jogger plates which are engageable with a stack of signatures and means for moving said first and second jogger plates relative to the stack of signatures, said first jogger plate includes a first section which extends parallel to the longitudinal axes of said first plurality of signature support elements and a second section which extends perpendicular to the longitudinal axes of said first plurality of signature support elements, said first section of said first jogger plate being engageable with a first end portion of a stack of signatures, said second section of said first jogger plate being engageable with a first side portion of the stack of signatures, said second jogger plate including a first section which extends parallel to the longitudinal axes of said second plurality of signature support elements and a second section which extends perpendicular to the longitudinal axes of said second plurality of signature support elements, said first section of said second jogger plate being engageable with a second end portion of the stack of signatures opposite from the first end portion of the stack of signatures, said second section of said second jogger plate being engageable with the first side portion of the stack of signatures.

57. An apparatus as set forth in claim 51 further including third drive means for rotating said platform about a vertical axis which extends between the first and second circuitous paths.

58. An apparatus as set forth in claim 57 wherein said third drive means includes a helical cam connected with said platform and having a central axis which is coincident with the vertical axis about which said platform is rotatable, a cam follower disposed in engagement with said helical cam, and motor means for moving said cam follower along a vertical path relative to said helical cam to rotate said platform.

59. An apparatus as set forth in claim 58 wherein said third drive means further includes a carriage connected with said cam follower and said motor means, and a linear vertical guide track, said carriage including means which engages said guide track to guide vertical movement of said carriage along said helical cam.

* * * * *